United States Patent [19]

Tanaka et al.

[11] Patent Number: 4,969,489

[45] Date of Patent: Nov. 13, 1990

[54] WEFT THREADING SYSTEM FOR FLUID JET LOOM USING THE STORAGE DRUM WINDING ARM

[75] Inventors: Kazuhiro Tanaka; Shinji Wakai; Masayuki Koriyama; Keizo Shizuka; Jotaro Uehara, all of Tokyo, Japan

[73] Assignee: Nissan Motor Co., Ltd., Yokohama, Japan

[21] Appl. No.: 359,797

[22] Filed: Jun. 1, 1989

[30] Foreign Application Priority Data

Jul. 14, 1988 [JP] Japan ..... 63-93340[U]
Aug. 2, 1988 [JP] Japan ..... 63-193170

[51] Int. Cl.[5] ..... D03D 47/34

[52] U.S. Cl. ..... 139/450; 139/435.1; 139/452; 139/116.2

[58] Field of Search ..... 139/435, 452, 116 A, 139/435.4, 450, 116.2, 435.1

[56] References Cited

U.S. PATENT DOCUMENTS

| | | | |
|---|---|---|---|
| Re. 30,318 | 7/1980 | Klinecky et al. | 139/452 |
| 4,002,190 | 1/1977 | Sevcink et al. | 139/452 |
| 4,378,821 | 5/1983 | Umezawa | 139/452 |
| 4,766,937 | 8/1988 | Kojima et al. | 139/452 |

FOREIGN PATENT DOCUMENTS

| | | |
|---|---|---|
| 0060234 | 9/1982 | European Pat. Off. . |
| 0171057 | 2/1986 | European Pat. Off. . |
| 0253359 | 1/1988 | European Pat. Off. . |
| 57-501869 | 10/1982 | Japan . |
| 59-47676 | 3/1984 | Japan . |
| 59-228047 | 12/1984 | Japan . |
| 60-2749 | 1/1985 | Japan . |
| 61-47849 | 3/1986 | Japan . |
| 62-45757 | 2/1987 | Japan . |
| 62-62974 | 3/1987 | Japan . |

*Primary Examiner*—Andrew M. Falik

*Attorney, Agent, or Firm*—Foley & Lardner, Schwartz, Jeffery, Schwaab, Mack, Blumenthal & Evans

[57] ABSTRACT

A weft threading system for threading a weft yarn prior to restart of weaving operations of a fluid jet loom. The weft threading system is comprised of a weft winding arm forming part of a weft storage unit, arranged to wind the weft yarn on a drum under relative rotation between the weft winding arm and the drum. The weft winding arm is pipe-shaped so that an air jet is passed therethrough and ejected from its tip end section. The tip end section of the weft winding arm is bent so that the air jet ejected therefrom is directed to a weft guide disposed separate from the weft storage unit and on the upstream side of a weft inserting or main nozzle. The weft guide ejects an air jet in order to suck the weft yarn and project it therefrom, so that the weft yarn from the weft winding arm is automatically passed through the weft guide into the weft inserting nozzle.

12 Claims, 28 Drawing Sheets

FIG. 38A
FIG. 38B
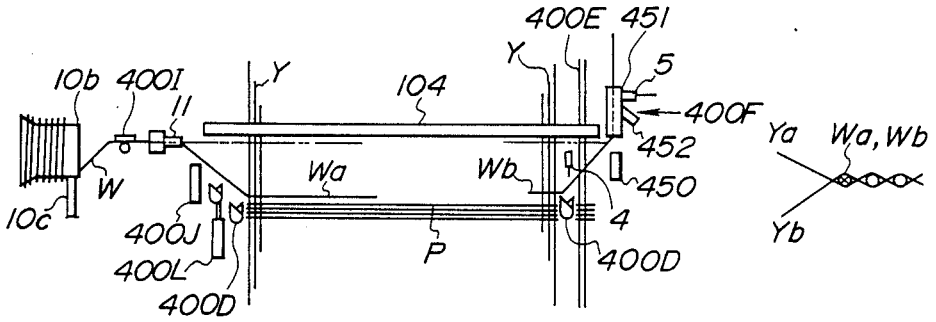
FIG. 39A
FIG. 39B
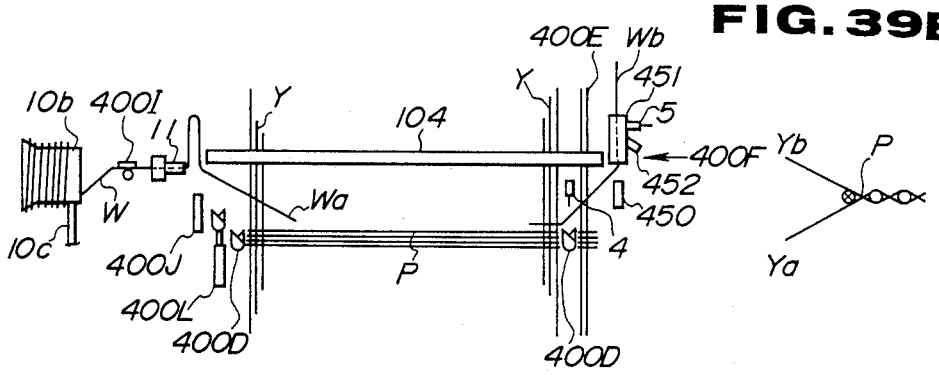

FIG. 40A
FIG. 40B
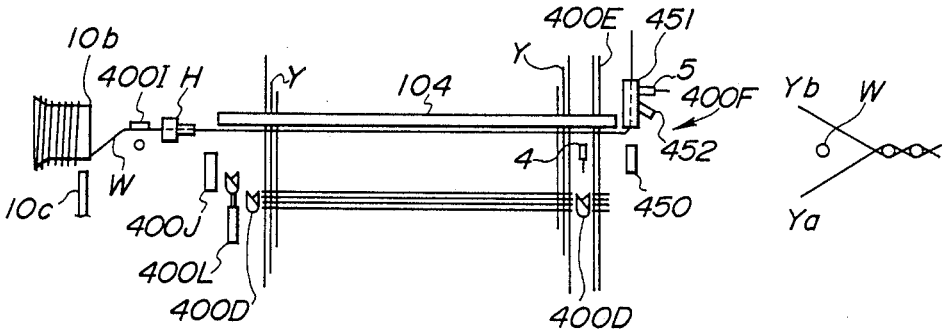
FIG. 41A
FIG. 41B
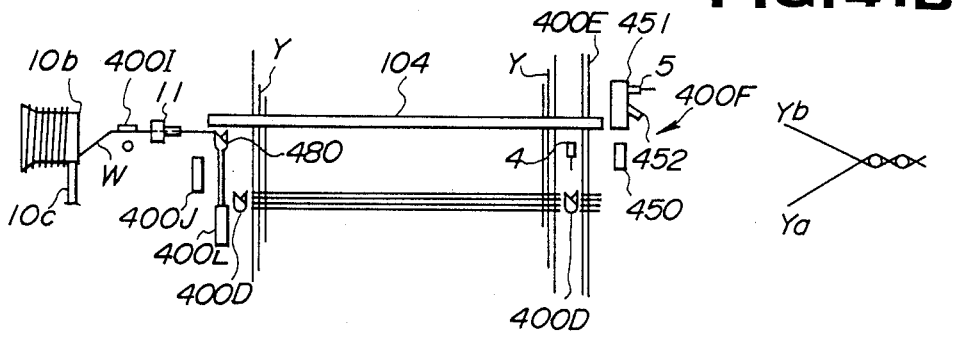

WEFT THREADING SYSTEM FOR FLUID JET LOOM USING THE STORAGE DRUM WINDING ARM

BACKGROUND OF THE INVENTION

1. Field of the Invention

This invention relates to a weft threading system for a fluid jet loom, and more particularly to improvements in an arrangement for automatically threading a weft yarn from a weft storage unit to a downstream side device under influence of a fluid jet.

2. Description of the Prior Art

An arrangement for automatically threading a weft yarn from a weft storage unit to a weft inserting nozzle has been proposed to be effected hen mispick occurs in a fluid jet loom, as disclosed in Japanese Provisional Publication No. 60-2479. During weaving operation of the loom provided with such an arrangement, the weft yarn drawn out from a weft supply member or bobbin is passed from the drum of a weft storage unit through a guide nozzle under an inoperative condition into a weft inserting nozzle. When mispick occurs under breakage of the weft yarn, weft threading operation is carried out as follows:

(1) When the weft yarn is broken or cut between the guide nozzle and the weft inserting nozzle, a suction pipe provided with a cutter is first moved from its withdrawal position to its operative position to suck and cut the weft yarn projected from the guide nozzle toward the side of the weft inserting nozzle. Subsequently air jet ejection is o made from the guide nozzle and from the weft inserting nozzle thereby to cause the weft yarn to fly toward the weft inserting nozzle under the influence of air jet ejected from the guide nozzle. The thus flying weft yarn is threaded into the weft inserting nozzle under suction generated at the inlet of the weft inserting nozzle.

(2) When the weft yarn is broken or cut between the weft storage unit and the guide nozzle, a guiding suction pipe provided with a fluid ejection nozzle is moved from its withdrawal position to its operative position on the side of the drum of the weft storage unit. Subsequently, air ejection is made from the fluid ejection nozzle of the guiding suction pipe, from the guide nozzle and from the weft inserting nozzle. Accordingly, the weft yarn wound on the drum of the weft storage unit is sucked into the guiding suction pipe and guide to the inlet of the guide nozzle. The thus guided weft yarn is threaded into the guide nozzle under suction generated at the inlet of the guide nozzle, and thereafter threaded into the weft inserting nozzle.

However, with the above-discussed arrangement, the suction pipe, the guide nozzle and the guiding suction pipe are adapted to move between their withdrawal position to operative position and therefore the construction of the arrangement and a mechanism for operating them unavoidably become complicated and large-sized while complicating devices around the weft storage unit and the weft inserting nozzle. This complicates control operations of the loom while making difficult maintenance and repair of the loom.

SUMMARY OF THE INVENTION

It is an object of the present invention to provide an improved weft threading system for a fluid jet loom, which is simple in construction and control operation and easy in maintenance while simplifying the construction of devices disposed around a weft storage unit and a weft inserting nozzle.

Another object of the present invention is to provide an improved weft threading system for a fluid jet loom, which includes a device which automatically accomplishes weft threading operation from the weft storage unit to the weft inserting nozzle under influence of controlled air jet flowing through the path of a weft yarn without using complicated devices which are required to move between their withdrawal position to their operative position.

The weft threading system of the present invention is for a fluid jet loom having a weft storage unit. The weft threading system is comprised of a weft winding arm forming part of the weft storage unit, arranged to wind a weft yarn in an amount over a level corresponding to one pick on a drum under relative rotation of the weft winding arm and the drum. The weft winding arm is adapted to eject a fluid jet from the tip end section. A downstream side device is disposed on the downstream side of the weft storage unit in the direction of movement of the weft yarn. The downstream side device is arranged to receive the weft yarn from the weft winding arm so that the weft yarn is threaded thereinto. The tip end section of the weft winding arm is arranged to direct the fluid jet therefrom toward the weft inlet of the downstream side device.

Accordingly, air jet ejected from the weft winding arm has a directivity toward the weft inlet of the downstream side device and therefore weft threading operation from the weft storage unit to the downstream side device can be accurately and readily accomplished without using complicated devices which are required to move between their withdrawal position and operative position. In other words, according to the present invention, such weft threading operation can be accomplished when mispick occurs, under a functionally stationary condition of the weft storage unit and a weft guide (as the downstream side device) which serve as functioning parts during loom weaving operation. As a result, the mechanism of devices around the weft storage unit and the weft inserting nozzle becomes simple thereby simplifying control operation and maintenance of the loom.

BRIEF DESCRIPTION OF THE INVENTION

In the drawings, like reference numerals designate corresponding elements and parts throughout all figures, in which:

FIGS. 38A, 38B, 39A, 39B, 40A, 40B, 41A and 41B are schematic plan views of the essential part of the loom of FIG. 35, illustrating the operation of the essential part;

DETAILED DESCRIPTION OF THE INVENTION

Figure 1:
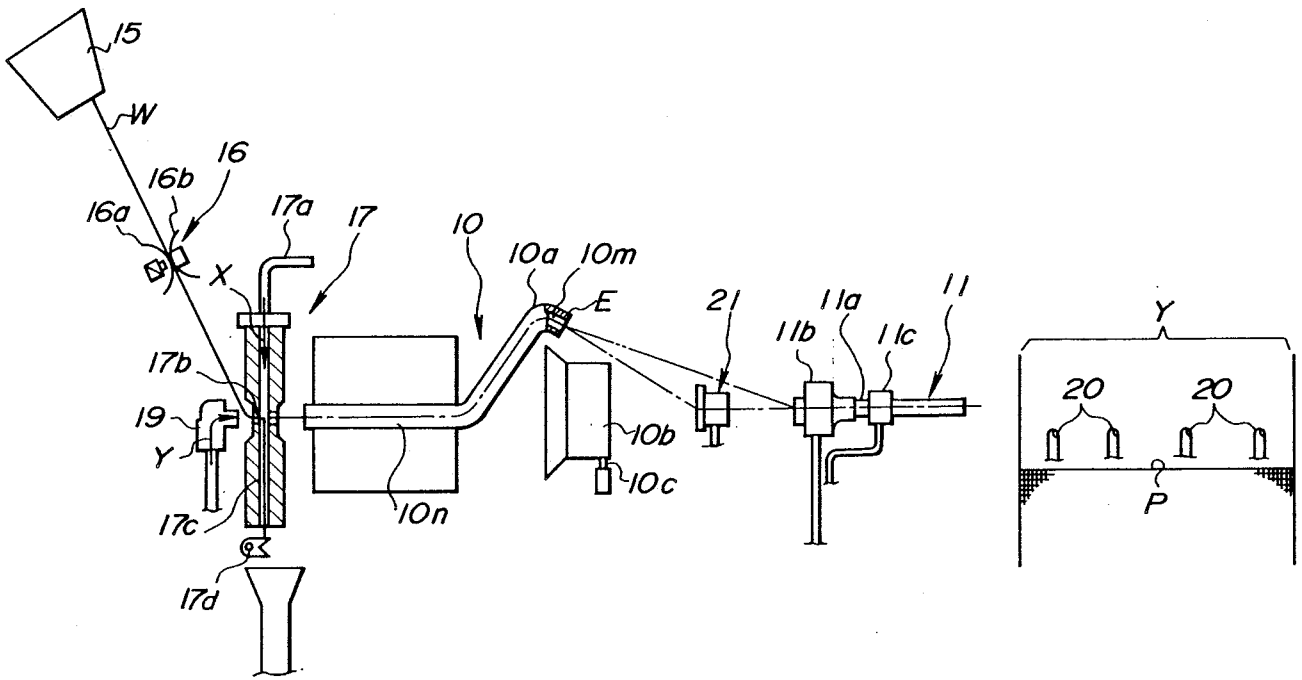
FIG. 1 is a schematic illustration of a first embodiment of a weft threading system according to the present invention.

Referring now to FIGS. 1 to 9 of the drawings, there is shown a weft picking system including a first embodiment of a weft threading system in a fluid (air) jet loom.

The weft picking system is generally arranged and operated as follows: A weft yarn W drawn from a yarn supply member or bobbin 15 is inserted into a pipe-shaped weft winding arm 10*a* of a weft storage unit 10. The tip end section of the weft winding arm 10*a* moves or rotates around a drum 10*b* of the weft storage unit 10. Accordingly, the weft yarn W from the weft winding arm 10*a* is wound on the drum 10*b* for the purpose of being measuring and stored by a predetermined length prior to weft picking. The weft yarn W wound on the drum 10*b* is passed through into a weft inserting nozzle (or main nozzle) 11. The weft inserting nozzle 11 is adapted to eject air jet therefrom in order to project the weft yarn W under influence of the air jet. The thus projected weft yarn W is inserted or picked into the shed formed in the array of warp yarns Y, thereby accomplishing a weft picking or insertion. During this weft picking, the air jet from the weft inserting nozzle 11 is enhanced and assisted by air jets ejected from a plurality of auxiliary nozzles 20 disposed along the insertion path of the weft yarn W. A measuring pawl 10*c* is movably provided to be inserted into and released (withdrawn) from the drum 10*b* in such a manner as to be engaged with and disengaged from the weft yarn W wound on the drum 10*b*. The measuring pawl 10*c* is adapted to be released from the drum 10*b* to be disengaged from the weft yarn during weft picking, while inserted into the drum to be engaged with the weft yarn to stop weft picking. Such a weft picking system is well known as disclosed in U. S. Pat. No. 4,378,821 entitled "Weft Detaining Device of Shuttleless Loom". Additionally, a weft storage unit similar to the above-mentioned is disclosed in U.S. Pat. No. 4,766,937 entitled "Weft Storage Device".

In this embodiment, a weft traction device 17 is disposed between the weft supply member 15 and the weft storage unit 10. A weft threading nozzle 19 is disposed on the weft inlet side of the weft traction device 17 in such a manner that the weft traction device 17 is disposed between the weft threading nozzle 19 and the weft storage unit 10. A weft tensor 16 is disposed between the weft threading nozzle 19 and the weft supply member 15.

As shown, the weft yarn W from the weft supply member 15 is passed through the weft tensor 16 and inserted into a weft introduction opening 17*b* of the weft traction device 17. The weft yarn passing through the weft introduction opening 17*b* is passed through a weft passage 10*m* which is formed through a drive shaft 10*n* of the weft winding arm 10*a* and connected with the elongate opening or weft passage (no numeral) of the weft winding arm 10*a*, so that weft yarn is drawn from the tip end section E of the weft winding arm 10*a*. The weft yarn W from the weft winding arm 10*a* is threaded into the weft inserting nozzle 11.

Under rotation of the weft winding arm 10*a* relative to the drum 10*b*, the weft yarn W engages with or is caught by the measuring pawl 10*c* (inserted into the drum 10*b*) so as to be wound on the drum 10*b* while being drawn out from the weft supply member 15. As a result, the weft yarn W in an amount corresponding to one pick or more is wound or stored on the drum. The weft winding arm 10*a* is adapted to be stopped at a predetermined position preventing interference with the measuring pawl 10*c* after the above winding operation of the weft yarn W. The measuring pawl 10*c* is withdrawn from the drum 10*b* at the initiation of weft picking in which the weft yarn W is projected from the weft inserting nozzle 11, while it is inserted into the drum 10*b* to engage with the weft yarn W when the picked weft yarn W reaches the counter-weft picking side (or at completion of one weft picking) after flying through the shed of the warp yarns Y under the influence of air jet ejected from the weft inserting nozzle 11. The counter-weft picking side is opposite to the weft picking side at which the weft inserting nozzle 11 is located, relative to the shed of the warp yarns Y. In this embodiment, a weft guide 21 is provided between the weft storage unit 10 and the weft inserting nozzle 11 so that the weft yarn W from the weft winding arm 10*a* is passed through the weft guide 21 and threaded into the weft inserting nozzle 11. In this connection, the tip end section E of the weft winding arm 10*a* is bent so as to be directed to the weft inlet of the weft guide 21. Accordingly, the weft yarn W is blown from the weft winding arm tip end section E toward the weft inlet of the weft guide 21 when an air jet is supplied through the weft passage 10*m* in the direction to be ejected from the weft winding arm tip end section E.

The weft traction device 17 includes a nozzle 17*a* which is adapted to eject air jet onto the weft yarn W passing through the weft introduction opening 17*b* generally in the direction perpendicular to the weft yarn W. In other words, the nozzle opening of the nozzle 17*a* merges into the weft introduction opening 17*b* in such a manner that they are perpendicular to each other. Additionally, a pipe 17*c* is provided to face with the nozzle opening and has a vertical opening merging in the weft introduction opening 17*b*. The weft yarn W blown by air jet from the nozzle 17 is forced into or received by the pipe 17*c*. A cutter 17*d* is disposed downstream of the pipe 17*c* to cut the weft yarn which is received by the pipe 17*c* and projected from the lower end section of the pipe 17*c*. The weft threading nozzle 19 is adapted to eject air jet toward the weft inlet of the weft introduction opening 17*b*.

The weft tensor 16 includes a pair of grasping members 16*a*, 16*b* which are arranged to incorporate with each other to maintain the weft yarn W therebetween. The weft tensor 16 is adapted to selectively take a weakly grasping condition, a strongly grasping condition, and a releasing condition for the weft yarn W. In the weakly grasping condition, the weft yarn W is weakly grasped so as to be possible to be drawn through the weft tensor 16 toward the weft storage unit 10 with some resistance. In the strongly grasping condition, the weft yarn W is strongly grasped so as to be impossible to be drawn through the weft tensor 16. In the releasing condition, the weft yarn W is not grasped, so as to be possible to be freely drawn through the weft tensor 16.

The weft inserting nozzle 11 includes a main body 11*a* which is formed with an axially extending opening (no numeral) through which the weft yarn W passes under influence of air jet flowing therethrough. The nozzle main body 11*a* is provided at its rear end section with a first ejector nozzle 11*b* and at its central section with a second ejector nozzle 11*c*. The first ejector nozzle 11*b* is adapted to eject an air jet through the axially extending opening of the nozzle 11 mainly for the purpose of threading the weft yarn W through the weft inserting nozzle 11. It will be understood that suction is generated at the weft inlet or the rear end section of the weft inserting nozzle 11 when the first and second ejector nozzles 11*b*, 11*c* eject air jet.

Figure 2:
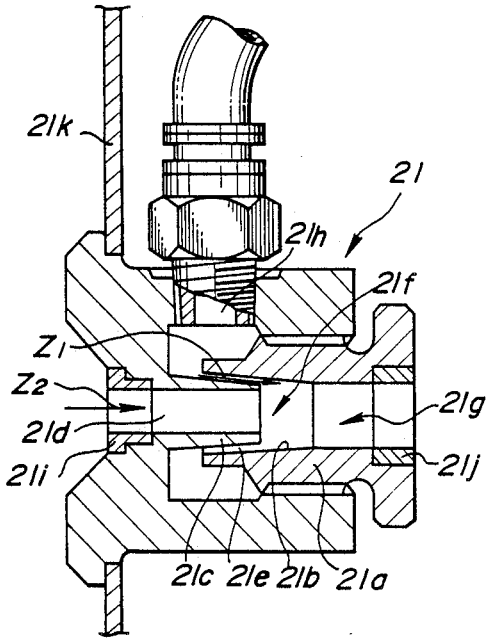
FIG. 2 is a longitudinal cross-sectional view of a weft guide used in the weft threading system of FIG. 1.

As shown in FIG. 2, the weft guide 21 includes a guide body 21*a* formed with an axial tapered hole 21*b*. A needle 21*c* formed with an axial weft introduction opening 21*d* is disposed within the axial tapered hole 21*b* of the guide body 21*a* in such a manner as to form a tapered annular air ejection opening 21*e* defined between the tapered outer surface of the needle 21*c* and the tapered inner surface of the guide body 21*a*. The thus formed air ejection opening 21*e* constitutes an ejector nozzle 21*f* through which air jet is ejected. The guide body 21*a* is also formed with a flow straightener opening 21*g* which has the same diameter throughout its length. The flow straightener opening 21*g* smoothly connects with the tapered hole 21*b* and is located on the downstream side of the tapered hole 21*b* in the direction of flow of air jet, i.e., on the side of the weft inserting nozzle 11. Accordingly, suction in a direction indicated by an arrow $Z_2$ is generated at the rear end section of the weft introduction opening 21*d* under the influence of air jet ejected in a direction indicated by an arrow $Z_1$. The flow straightener opening 21*g* functions to provide a directivity for air jet to be ejected from the weft guide 21 in order to accurately direct the weft yarn W projected from the weft guide 21 toward the weft inlet of the weft inserting nozzle 11. A pipe 21*h* is fluidly connected with the tapered air ejection opening 21*e* to supply pressurized air into the opening 21*e*. In FIG. 2, the reference numerals 21*i*, 21*j* denote annular guide members securely fitted at the weft inlet and outlet of the weft guide 21, respectively. The reference numeral 21*k* denotes a bracket for the weft guide 21.

The manner of operation of the weft threading system will be discussed hereinafter.

When a mispick occurs during weaving operation of the loom, the weft tensor 16 is first brought into its strongly grasping condition thereby to prevent the weft yarn W from being drawn out from the weft supply member 15. Then, air jet is ejected from the nozzle 17*a* of the weft traction device 17 to blow the weft yarn W within the weft introduction opening 17*b* from the side direction or a direction indicated by an arrow X in FIG. 1. Simultaneously, the weft winding arm 10*a* is reversely rotated thereby unwinding the weft yarn W wound on the drum 10*b*. As the weft yarn W unwinds from the drum 10*b*, the weft yarn W strongly grasped by the weft tensor 16 is blown into the pipe 17*c* under the influence of air jet from the nozzle 17*a*. When the weft yarn W is drawn and removed from the weft inserting nozzle 11 and the weft storage unit 10, the reverse rotation of the weft winding arm 10*a* is stopped so as to locate the weft winding arm 10*a* at a predetermined position while operating the cutter 17*d* to cut the weft yarn W which is sucked and projected downward of the pipe 17*c*. Thereafter, air ejection from the nozzle 17*a* is stopped, in which the weft yarn W is located as indicated by solid line in FIG. 1.

Subsequently, the weft tensor 16 is so operated to alternately take the weakly grasping condition (or releasing condition) and the strongly grasping condition while ejecting air is made in the weft threading nozzle 19, in the weft guide 21 and in the weft inserting nozzle 11. In this air ejection, the weft threading nozzle 19 ejects an air jet in a direction indicated by an arrow Y, and the weft guide 21 ejects an air jet in the direction of the weft inserting nozzle 11. In the air ejection Of the Weft inserting nozzle, air ejection is made in the first and second ejector nozzles 11*b*, 11*c* thereby generating suction at the weft inlet or rear end section of the weft inserting nozzle main body 11*a*.

Accordingly, the weft yarn W supplied through the weft tensor 16 from the weft supply member 15 and extended through the weft introduction opening 17*b* is passed into the weft passage 10*m* formed in the weft winding arm 10*a* under the influence of the air jet ejected from the weft threading nozzle 19 and projected from the tip end section E of the weft winding arm 10*a*. The weft yarn W from the weft winding arm 10*a* then reaches the vicinity of the weft inlet or rear end section of the weft guide 21 under the influence of air jet ejected from the weft winding arm tip end section E, and then is taken into the weft introduction opening 21*d* of the weft guide 21 under the vacuum generated at the weft inlet of the weft guide 21. Then, the weft yarn W within the weft guide 21 is projected from the weft guide 21 under the influence of air jet ejected from the air ejection opening 21*d* of the weft guide 21 and reaches the vicinity of the weft inlet or the rear end section of the weft inserting nozzle 11. Then, the weft yarn W is sucked into the weft introduction opening of the weft inserting nozzle 11 under vacuum generated at the vicinity of the weft inlet or rear end section of the weft inserting nozzle 11, and projected from the weft inserting nozzle 11 under the influence of combination of air ejections from the first and second ejector nozzles 11*b*, 11*c*. The thus projected weft yarn W flies through the shed of the warp yarns Y toward the counter-weft picking side to accomplish a weft picking.

Thereafter, the weft tensor 16 is brought into its weakly grasping condition while stopping air ejection in the weft threading nozzle 19 and in the second ejector nozzle 11*c*. Simultaneously, the air pressure in the first ejector nozzle 11*b* is set at a predetermined level for weft picking in weaving operation. Then, the measuring pawl 10*b* is inserted into the drum 10*b* and the weft winding arm 10*a* is normally rotated to wind the weft yarn Y on the drum 10*b*. When the wound amount of the weft yarn Y reaches a predetermined level over a level corresponding to one pick, the normal rotation of the weft yarn W is stopped thereby restarting the weaving operation of the loom. Thus, a series of treatment for the mispicked weft yarn W is completed.

It will be understood that a control circuit (not shown) is provided to control air ejection in the weft threading nozzle 19, the nozzle 17*a*, the weft guide 21 and the weft inserting nozzle 11, and to control operation of weft tensor 16, the weft winding arm 10*a*, the measuring pawl 10*c* and the cutter 17*d* in accordance with operational conditions of the loom.

Figure 3:
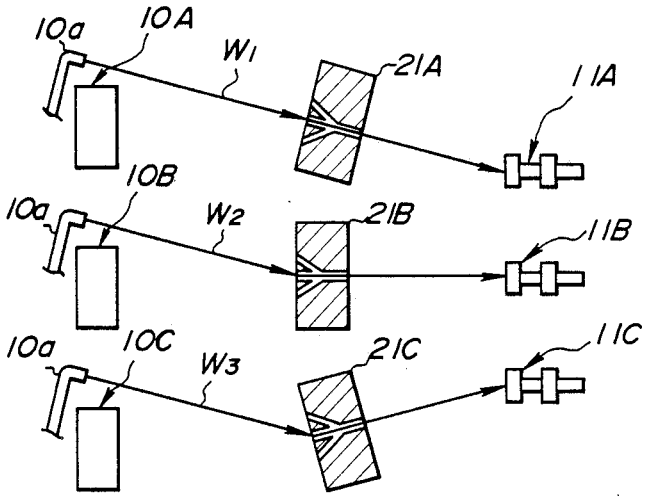
FIG. 3 is a schematic illustration of an essential part of a modified embodiment of the first embodiment weft threading system.

FIG. 3 illustrates a modified example of the first embodiment weft threading system in accordance with the present invention, which is similar to the first embodiment system with the exception that weaving is carried out using a plurality of weft yarns $W_1$, $W_2$, $W_3$ as in a multi-color weaving. In this embodiment, a plurality of weft guides 21A, 21B, 21C are provided corresponding to the respective weft winding arms 10*a* of a plurality of weft storage units 10A, 10B, 10C. Additionally, a plurality of weft inserting nozzles 11A, 11B, 11C are provided corresponding to the respective weft guides 21A, 21B, 21C. The construction of each of the weft guides 21A, 21B, 21C is similar to that of the air guide 21 of the first embodiment. The construction of each of the weft storage units 10A, 10B, 10C is similar to that of the weft storage unit 10 of the first embodiment. The construction of each of the weft inserting nozzles 11A, 11B, 11C is similar to that of the weft inserting nozzle 11 of the first embodiment. The weft yarns $W_1$, $W_2$, $W_3$ are selectively picked from the respective weft picking nozzles 11A, 11B, 11C.

While the weft threading system of the present invention has been shown and described as being used in combination with an air jet loom, it will be understood that the weft threading system may be used in combination with a water jet loom. Additionally, the weft guide 21 (21A to 21C) may be arranged to move together with the weft inserting nozzle 11 (11A to 11C) as a one-piece unit, in which movement of the weft guide 21 (21A to 21C) is stopped when the tip end section or outlet section E of the weft winding arm 10*a* is positioned to be directed to the weft inlet of the weft guide 21 during a weft threading process.

FIGS. 4 to 9 illustrates a second embodiment of the weft threading system in accordance with the present invention, which is similar to the first embodiment weft threading system. Operation of this weft threading system in combination with the weft picking system will be summarized as follows:

During weaving operation of the loom, when mispick (for example, the leading end of a picked weft yarn W not reaching the counter-weft picking side, or a weft yarn W being broken or cut) occurs, a control circuit 13 first stops cutting action of a normally used cutter 14 for cutting the picked weft yarn W in a predetermined length, i.e., stops the cutting function of the loom. Thereafter, normal rotation of a loom main shaft (not shown) is stopped thereby stopping weaving operation of the loom. The weaving operation of the loom is in timed relation to rotation of the loom main shaft which is driven by a motor. The rotation of the loom main shaft is usually stopped at a next weaving cycle relative to a weaving cycle in which the mispick has been found. Then, upon a time delay from finding of the mispick to the complete stop of loom operation, the control circuit 13 causes the loom main shaft to reversely rotate at a speed lower than in normal rotation, thus accomplishing reverse revolution of the loom. This reverse rotation of the loom main shaft is stopped at a timing in which a reed (not shown) at the weaving cycle causing the mispick is at its most-rearward position and the shed of the warp yarns Y takes its maximum opening. Upon such reverse revolution of the loom, upper and lower arrays of warp yarns Y are alternately replaced with each other thereby to cause the mispicked or faulty weft yarn to be exposed at a cloth fell P of a woven fabric (not identified). Subsequently, the control circuit 13 works, in accordance with causes of occurrence of mispick, to selectively operate a weft traction device 12 of the suction type, a weft traction device 40 of the grasping and pulling type, the weft guide 21, a weft feeding device F, the weft tensor 16, a weft supply nozzle or device 44, a storage device 43 for weft threading, a pig tail cutter 42, pig tail tensors 50, thus removing the mispicked weft yarn. The weft traction device 12 is disposed on the counter-weft picking side relative to a sensor 4 which detects normal weft picking of the weft yarn W, and is arranged to suck the weft yarn W thereinto when operated. The weft traction device 40 is arranged to grasp the mispicked weft yarn W and pull it from a side direction. The weft guide 21 has the same construction as the weft guide 21 as shown in FIG. 2 and is disposed between the weft storage unit 10 and the weft inserting nozzle 11. The weft feeding device F, the weft tensor 16, the weft supply device 44, the storage device 43, the pig tail cutter 42 and the pig tail tensors 50 are located in the mentioned order on the upstream side of the weft storage unit 10.

In this embodiment, the measuring pawl **10*c* is operated by an actuator 10*f* of the electromagnetic type and is arranged to be withdrawn from the drum 10*c* at the initiation of weft picking and to be inserted into the drum 10*c* to engage with the weft yarn W when the picked weft yarn W reaches the counter-weft picking side (or at completion of one weft picking) after flying through the shed of the warp yarns Y under the influence of air jet ejected from the weft inserting nozzle 11. The tip end section E of the weft winding arm 10*a* is directed to the weft inlet or rear end section of the weft guide 21 so that the air ejected from the weft winding arm tip end section E is effectively supplied to the vicinity of the weft guide inlet. Similarly, the axis of the weft guide 21 is directed to the weft inlet or rear end section of the weft inserting nozzle 11 so as to effectively supply an air jet from the weft guide 21 to the vicinity of the weft inlet of the weft inserting nozzle 11. The weft feeding device F is constituted by the weft traction device 17 and the weft threading nozzle 19**.

Figure 7:
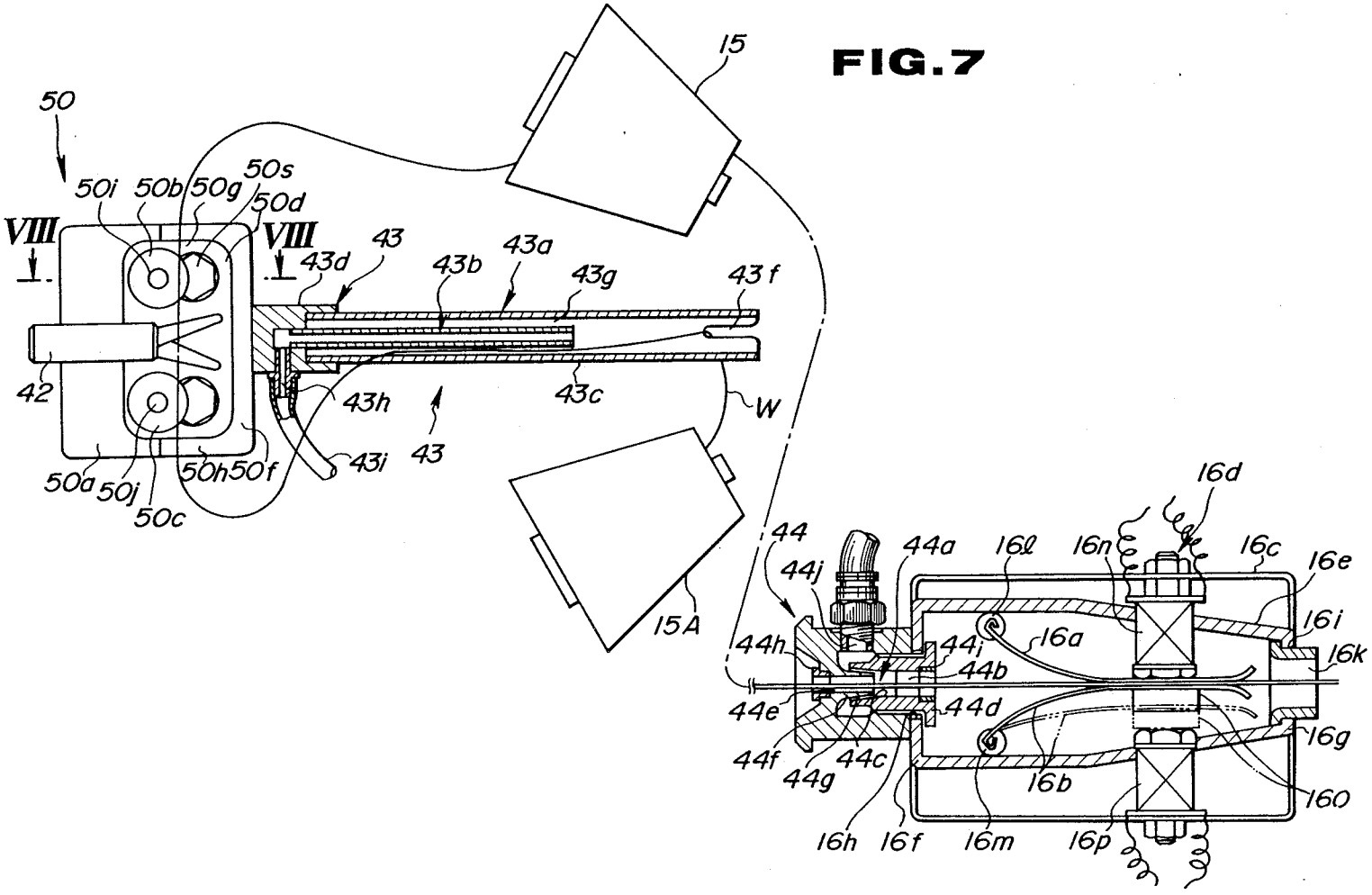
FIG. 7 is a plan view, partly in section, of an essential part of the weft threading system of FIG. 1.

The weft tensor 16 has a pair of grasping members **16*a*, 16*b* which are arranged to incorporate with each other to maintain the weft yarn W therebetween. The weft tensor 16 is adapted to selectively take the weakly grasping condition, the strongly grasping condition and the releasing condition. In the weakly grasping condition, the weft yarn W is weakly grasped so as to be possible to be drawn through the weft tensor 16 toward the weft storage unit 10 with some resistance. In the strongly grasping condition, the weft yarn W is strongly grasped so as to be impossible to be drawn through the weft tensor 16. In the releasing condition, the weft yarn W is not grasped so as to be possible to be freely drawn through the weft tensor 16. More specifically, as shown in FIG. 7, the weft tensor 16 includes a main body 16*c* in which the grasping members 16*a*, 16*b* are disposed so as to selectively take the above three conditions under action of a change-over device 16*d*. The main body 16*c* includes a casing 16*e* which is provided with right and left side walls 16*f*, 16*g* which are respectively formed with circular openings 16*h*, 16*i*. A generally cylindrical guide 16*k* provided with an annular flange is fitted in the circular opening 16*i* of the side wall 16*g*, so that a weft introduction opening is defined by the cylindrical guide 16*k***.

The grasping members **16*a*, 16*b* are assembled in the main body 16*c* in such a manner that the weft yarn W is passed through between the grasping members 16*a*, 16*b*. The grasping members 16*a*, 16*b* are formed of an elongate leaf spring and are fixed at their rear end section to support shafts 16*l*, 16*m* which are adjustably fixed to the casing 16*e*. The front end section of each of the grasping members 16*a*, 16*b* is in contact with each other under a condition in which the grasping members 16*a*, 16*b* bias with each other so that the weft yarn W is passed through between the grasping members 16*a*, 16*b*. In this embodiment, the grasping member 16*a* is made of nonmagnetic material such as stainless steel. The change-over device 16*d* includes a first electromagnet 16*n* located on the side of the nonmagnetic grasping member 16*a* and installed to the casing 16*e*. A permanent magnet 16*o* is installed to the back side of the other grasping member 16*b*. A second electromagnet 16*p* is disposed on the side of the permanent magnet 16*o* and installed to the casing 16*e*. The strongly grasping condition of the weft tensor 16 is accomplished by supplying electric current to the first electromagnet 16*n* while by interrupting supply of electric current to the second electromagnet 16*p*. The weakly grasping condition of the weft tensor 16 is accomplished by interrupting the supply of electric current to both the first and second electromagnets 16*n*, 16*p*. The releasing condition of the weft tensor 16 is accomplished by interrupting the supply of electric current while supplying electric current to the second electromagnet 16*b*. Such a control manner for the weft tensor 16 is shown in Table 1. Otherwise, the weft tensor 16 may be controlled in the following manner: The first and second electromagnets 16*n*, 16*p* are respectively supplied with electric currents which are opposite in flow direction to each other thereby accomplishing the strongly grasping or releasing condition; and the supply of electric current to the first and second electromagnets 16*n*, 16*p* is interrupted thereby accomplishing the weakly grasping condition. Such a control manner for the weft tensor 16** is shown in Table 2.

TABLE 1

| | Electric current | | |
|---|---|---|---|
| | 1st electro-magnet 16n | 2nd electro-magnet 16p | Operation |
| Strongly grasping condition | Supplied | Inter-rupted | Permanent magnet 16 is attracted to 1st electro-magnet 16n, so that grasping members 16a, 16b are in strong contact with each other. |
| Weakly grasping condition | Inter-rupted | Inter-rupted | Grasping members 16a, 16b are in contact with each other under elasticity of |

TABLE 1-continued

| | Electric current | | |
|---|---|---|---|
| | 1st electro-magnet 16n | 2nd electro-magnet 16p | Operation |
| | | | themselves. |
| Releas-ing condition | Inter-rupted | Supplied | Permanent magnet 11o is attracted to 2nd electro-magnet, so that grasping members 16a, 16b are separate from each other. |

TABLE 2

| | Electric current | | |
|---|---|---|---|
| | 1st electromagnet 16n | 2nd electromagnet 16p | Operation |
| Strongly grasping condition | Supplied | Supplied oppo-sitely in flow direction rela-tive to 1st electromagnet | Permanent magnet 16o is attracted to 1st electro-magnet 16n while repulsed to 2nd electromagnet 16p, so that grasping members 16a, 16b are in strong contact with each other. |
| Weakly grasping condition | Interrupted | Interrupted | Grasping members 16a, 16b are in contact with each other under elasticity of themselves. |
| Releasing condition | Supplied oppositely in flow direction relative to 1st electromagnet in strongly grasping condition | Supplied oppositely in flow direction relative to 1st electromagnet in releasing condition | Permanent magnet is repulsed to 1st electro-magnet 16n while attracted to 2nd electromagnet 16p, so that grasping members 16a, 16b are separate from each other. |

As shown in FIG. 7, the weft supply device 44 is assembled with the weft tensor 16 in such a manner as to connect with the weft inlet side of the weft tensor 16. The weft supply device 44 includes a body **44*d* formed with an axial tapered hole 44*c*. A needle 44*f* formed with an axial weft introduction opening 44*e* is disposed within the axial tapered hole 44*c* of the body 44*d* in such a manner as to form a tapered annular air ejection opening 44*g* defined between the tapered outer surface of the needle 44*f* and the tapered inner surface of the body 44*d*. The thus formed air ejection opening 44*g* constitutes an ejector nozzle 44*a* through which air jet is ejected. The body is also formed with a flow straightener opening 44*b* which has the same diameter throughout its length. The flow straightener opening 44*b* smoothly connects with the tapered hole 44*c* and is located on the downstream side of the tapered hole 44*c* in the direction of flow of the air jet, i.e., on the side of the weft tensor 16. Accordingly, suction is generated at the rear end section of the weft introduction opening 44*e* under the influence of air jet ejected through the ejector nozzle 44*a*. The flow straightener opening 44*b* functions to provide a directivity to the air jet to be ejected from the ejector nozzle 44*a* so as to accurately direct the weft yarn W projected from the weft supply device 44 toward between the grasping members 16*a*, 16*b* of the weft tensor 16. A pipe 44*j* is fluidly connected with the tapered air ejection opening 44*g* to supply pressurized air into the opening 44*g*. Annular guide members 44*h*, 44*i* are securely fitted at the weft inlet and outlet of the weft supply device 44, respectively. As clearly shown in FIG. 7, the body 44*d* is provided at its front end section with an annular flange (no numeral) and fitted in the circular opening of the left side wall 16*f* of the casing 16*e* of the weft tensor 16 in such a manner as to be coaxial with the weft tensor 16**.

Figure 9:
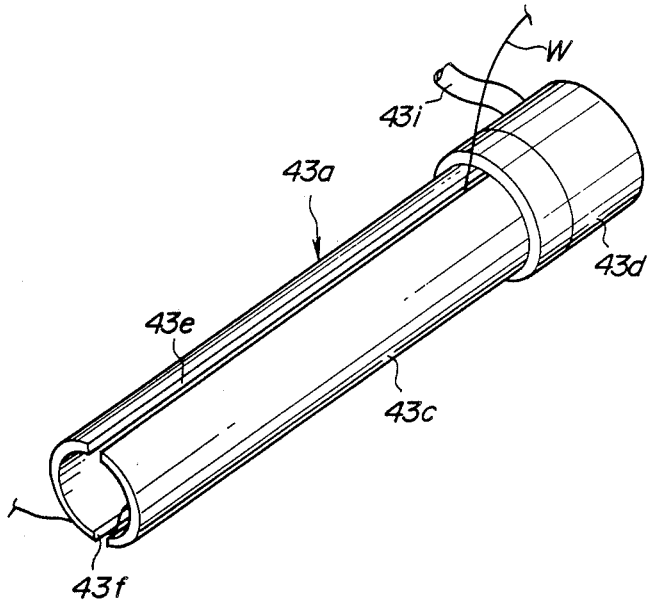
FIG. 9 is a perspective view of a storage device for weft threading, of the essential part of FIG. 7.

As illustrated in FIGS. 7 and 9, the storage device 43 for weft threading is generally constituted by a storage section **43*a* and a nozzle 43*b*. The storage pipe 43*a* functions to store therein a predetermined amount of a pig tail connecting section between the yarns of the weft supply member 15 and the auxiliary weft supply member 15A during threading the weft yarn W, the predetermined amount being required for the weft yarn reaching the vicinity of the weft inlet or rear end section of the weft supply device 44 assembled with the weft tensor 16. More specifically, the storage section 13*b* includes a straightly extending pipe 43*b* which is fixedly secured through a base block 13*d* to a casing 50*a* of a pig tail tensor 50. The pipe 43*c* is formed with a slit 43*e* and a groove 43*f* which pass through the wall of the pipe 43*c*. The slit 43*e* extends axially from the tip or front end to the vicinity of the base or rear end of the pipe 43*c*. The groove 43*f* is formed at the tip end section of the pipe 43*c* and is located opposite to the slit 43*e* in the diametrical direction of the pipe 43*c* or with respect to the axis of the pipe 43*c***.

The nozzle **43*b* of the pipe shape functions to project the tip end section of the weft yarn W which is inserted through the slit 43*e* into the pipe 43*c*, toward the side of the weft storage unit 10, more specifically toward the weft inlet or rear end section of the weft supply device 44. As clearly seen from FIG. 7, the nozzle 43*b* is securely fixed at its rear end section to the base block 43*d* in such a manner as to form an annular clearance 43*g* between the outer peripheral surface thereof and the inner peripheral surface of the pipe 13*c*. A tube 43*i* for supplying pressurized air is fluidly connected through a hose connector 43*h* to the nozzle 13*b*. The nozzle 43*b* has such a length that its tip or front end is located generally at the intermediate part of the pipe 43*c***.

The pig tail cutter 42 is assembled with the pig tail tensor 50 and is adapted to cut the pig tail section of the weft yarn W at a part located between the cooperative grasping members **50*b*, 50*c* for the using weft supply member 15 and the auxiliary weft supply member 15A. The pig tail tensor 50** is adapted to grasp and release the pig tail section of the weft yarn W.

Figure 8:
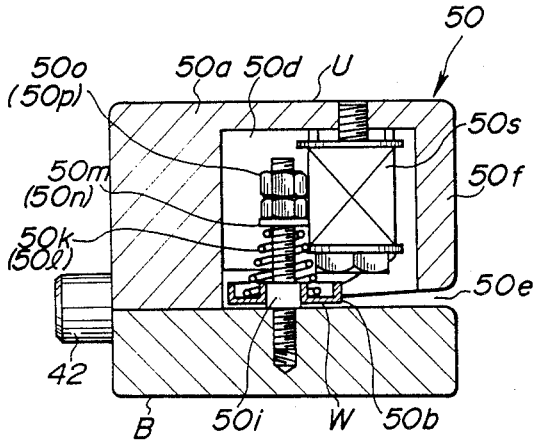
FIG. 8 is a cross-sectional view of a pig tail tensor of the essential part of FIG. 7, taken in the direction of arrows substantially along the line VIII—VIII of FIG. 7.

As illustrated in FIGS. 7 and 8, the pig tail tensor 50 includes a casing **50*a* defining therein a chamber or space 50*d*. The casing 50*a* has a front wall 50*f* and left and right walls 50*g*, 50*h*. A groove or cutout 50*e* is formed through the walls 50*f*, 50*g*, 50*h* and merges in the chamber 50*d*. The groove 50*e* reaches the middle part of the left and right walls 50*g*, 50*h* in the fore and aft direction of the pig tail tensor 50. The casing 50 includes a bottom wall B defining the chamber 50*d*. Two guide posts 50*k*, 50*l* are are vertically screwed into the bottom wall B and located on the opposite sides of the pig tail cutter 42. Generally disc-shaped grasping members 50*b*, 50*c* are respectively fitted around the guide posts 15*k*, 15*l* in such a manner as to be movable along the axis of the guide post. Spring seats 50*m*, 50*n* are respectively axially movably fitted around the guide posts 15***k*, 15*l* and prevented from getting out of the guide posts by means of respective double nuts 50*o*, 50*p*. Set springs 50*q*, 50*r* are respectively mounted on the guide posts 15*k*, 15*l* in such a manner that each is interposed between the grasping member 50*b*, 50*c* and the spring seat 50*m*, 50*n*. Additionally, Electromagnets 50*s*, 50*t* are installed to the upper wall U defining the chamber 15*d* of the casing 50*a*, and are located corresponding to the grasping members 15*b*, 15*c*, respectively. Accordingly, when supply of electric current to the electromagnets 50*s*, 50*t* is interrupted, the grasping members 50*b*, 50*c* are forced downwardly to contact with the bottom wall B of the casing 15*a* under the bias of the set springs 15*q*, 15*r* thereby grasping the pig tail section of the weft yarn W inserted in the groove 50*e* under cooperation of the grasping members and the bottom wall. On the contrary, when electric current is supplied to the electromagnets 15*s*, 15*t*, the grasping members 50*b*, 50*c* are forced upwardly against the bias of the set springs 15*q*, 15*r* thereby releasing the weft yarn pig tail section.

The manner of operation of the thus arranged weft threading system will be discussed hereinafter.

When mispick occurs during weaving operation of the loom, the loom is stopped and thereafter reversely revolved and stopped to remove the mispicked or faulty weft yarn W from the loom by a removing operation depending upon a cause of the mispick. Thereafter, threading operation is made to restart weaving operation of the loom. Here, discussion will be made on the assumption that the weft yarn W is broken or cut at a position between the weft supply member 15 and the weft storage unit 10. When the loom is stopped and then reversely revolved and stopped, the control circuit 13 operates to carry out the following operations: The measuring pawl 10*c* is withdrawn from the drum 10*b*; an air jet is ejected from the weft inserting nozzle 11 to unwind the faulty weft yarn W wound on the drum 10*b*; and the suction type weft traction device 12 and the grasping type weft traction device 40 are driven. As a result, the faulty weft yarn W is extracted from the array of the warp yarns Y without being broken at its middle section, loosening adherence of the weft yarn W with the warp yarns under cooperation of traction force of the traction device 40 and suction of the traction device 12.

Figure 4:
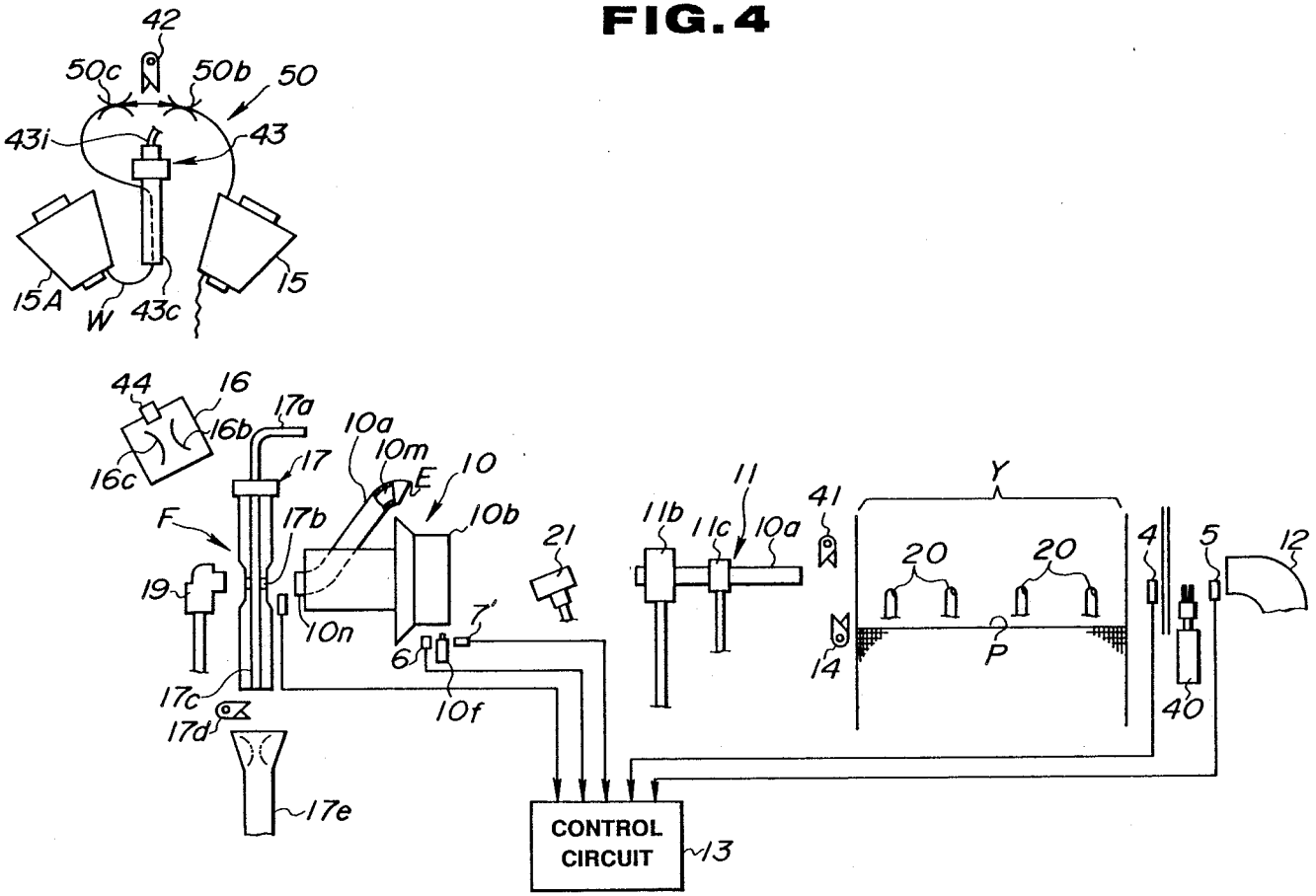
FIG. 4 is a schematic illustration of a second embodiment of the weft threading system according to the present invention, showing a state in which a faulty weft yarn has been removed.
Figure 5:
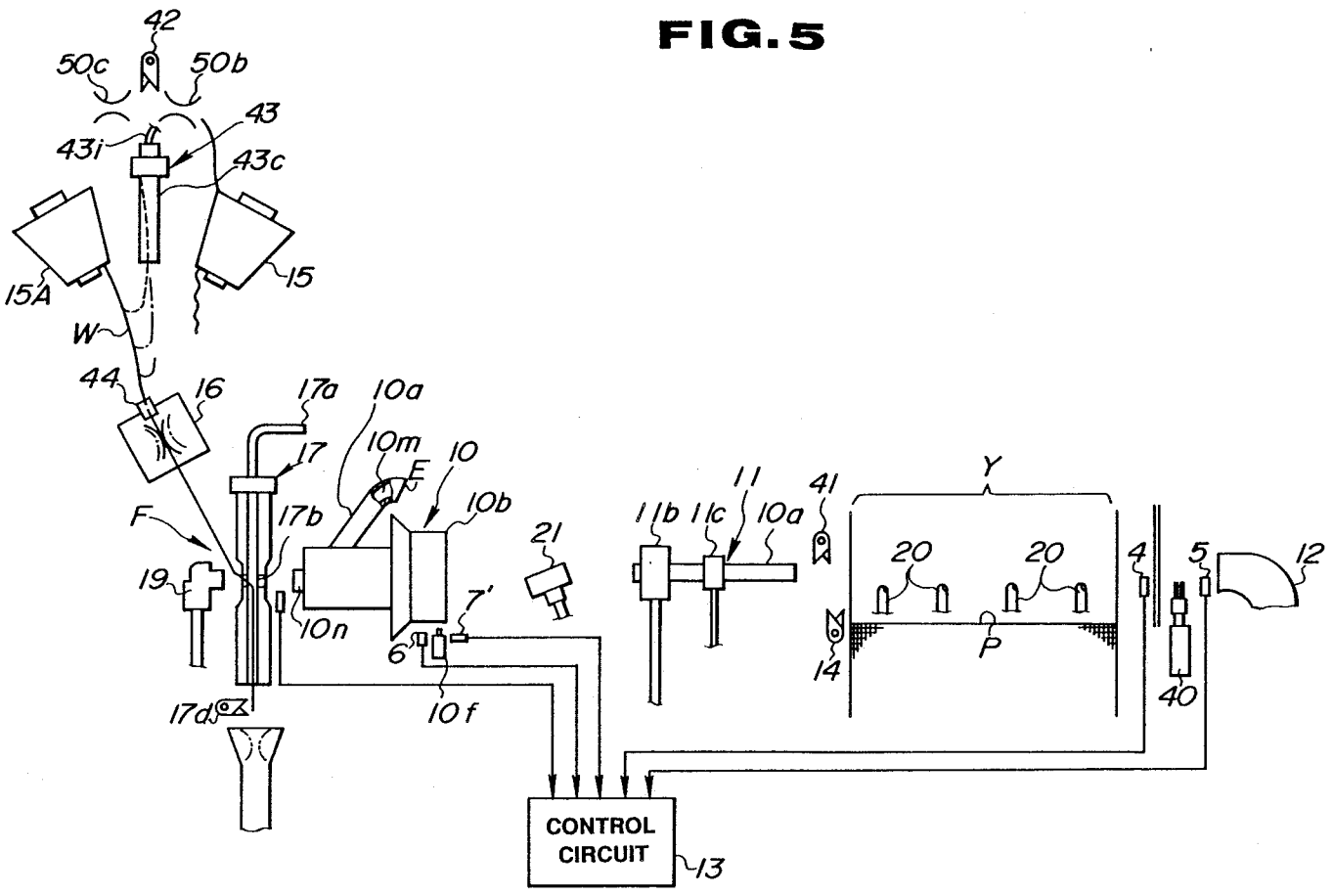
FIG. 5 is a schematic illustration similar to FIG. 1 but showing another state in which a weft yarn is being threaded through the path of the weft yarn.

Then, as shown in FIG. 4, the control circuit 13 operates to cause the tensor 16 to be brought into the releasing condition and the pig tail cutter 42 to make cutting action thereby cutting the pig tail section of the yarn between the weft supply member 15 and the auxiliary weft supply member 15A. Subsequently, as shown in FIG. 5, the control circuit 13 operates to cause air ejection in the nozzle 43*b*of the storage device 43, the weft supply device 44, the weft guide 21 and the weft inserting nozzle 11. Accordingly, the leading end section of the weft yarn W from the auxiliary weft supply member 15A is projected from the storage section 43*a* of the storage device 43 toward the weft inlet or rear end section of the weft supply device 44. The weft yarn W is sucked into the weft introduction opening 44*e* and the flow straightener opening 44*b* under suction generated at the weft inlet of the weft supply device 44, and is then fed into the weft tensor 16 under the releasing condition in which the weft yarn W passes through between the grasping members 16*a*, 16*b* which are separate from each other. Then, the weft yarn W is threaded into the weft introduction opening 17 to be forced into the pipe 17*c* of the weft traction device 17 forming part of the weft feeding device F. The thus forced weft yarn W is cut at a part projected downward from the pipe 17*c* by the cutter 17*d*.

Figure 6:
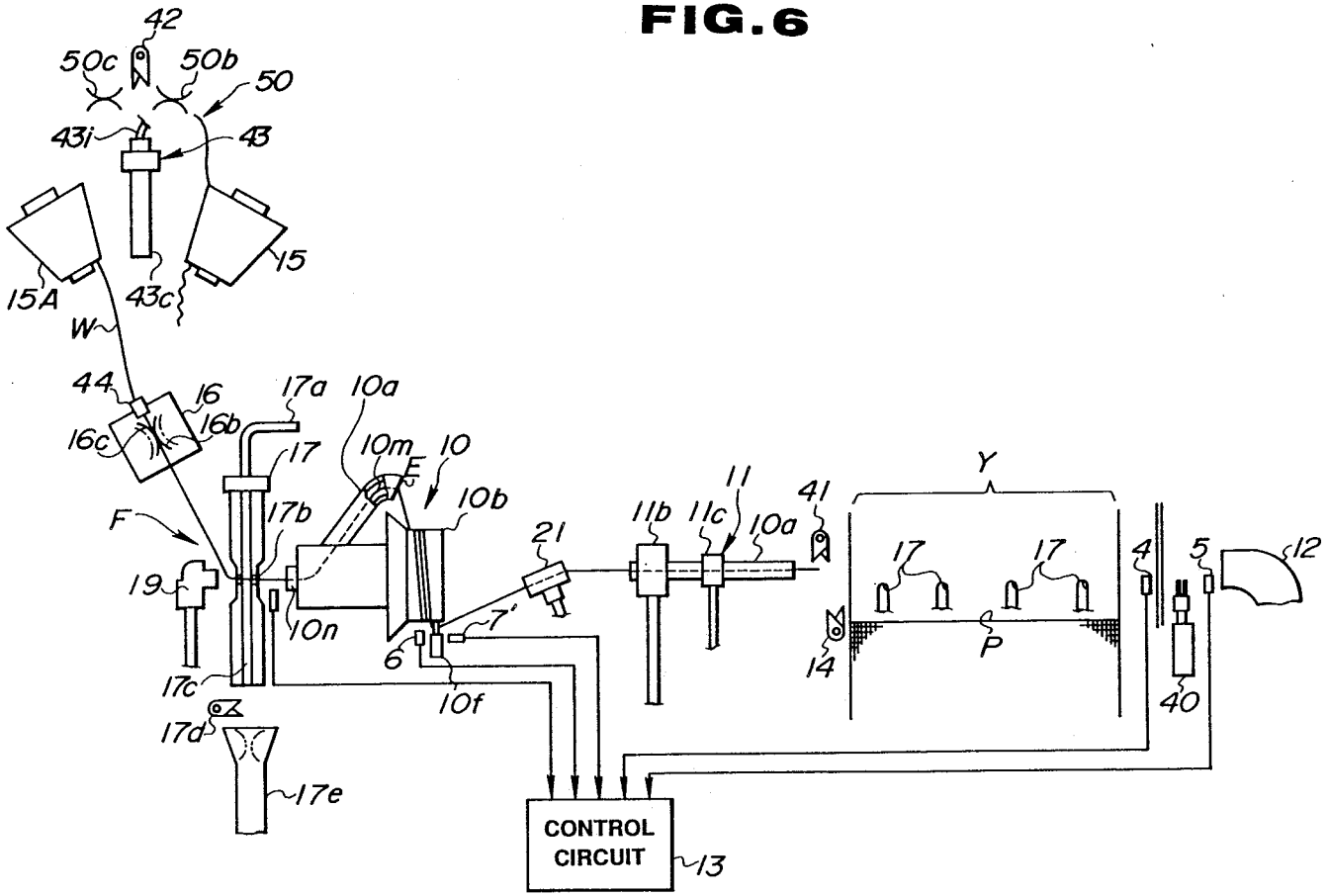
FIG. 6 is a schematic illustration similar to FIG. 1 but showing a further state in which a weft threading operation has been completed.

Thereafter, as shown in FIG. 6, the control circuit 13 operates to stop air jet ejection in the nozzle 43*b* of the storage device 43, the weft supply device 44, and the nozzle 17*a* of the weft traction device 17 forming part of the weft feeding device F. At this time, air jet ejection is made from the weft threading nozzle 19 while bringing the weft tensor 16 into the weakly grasping condition or into a state in which the releasing and strongly grasping conditions are alternately repeated. Additionally, air jet ejection is made in the weft guide 21 and in the weft inserting nozzle 11. Under this air jet ejection in the weft guide 21, vacuum is generated at the weft inlet or rear end section of the weft inserting nozzle 11, and the first and second ejector nozzles 11*b*, 11*c* eject the air jet, thereby generating vacuum at the weft inlet or rear end section of the weft inserting nozzle 11. Accordingly, the weft yarn W extended through the weft tensor 16 from the weft supply member 15 and passing through the weft introduction opening 17*b* of the weft traction device 17 is first forced to be passed through the weft passage or opening 10*m* of the weft winding arm 10*a* under the influence of the air jet from the weft threading nozzle 19 and reaches the vicinity of the weft inlet or rear end section of the weft guide 21 under the influence of the air jet ejected from the tip end section E of the weft winding arm 10*a*. Then, the weft yarn W is sucked into the weft guide 21 under the action of vacuum generated at the weft inlet of the weft guide 21 and reaches the vicinity of the weft inlet or rear end section of the weft inserting nozzle 11. At this time, the weft yarn W is sucked into the weft inserting nozzle 11 under vacuum generated at the weft inlet of the weft inserting nozzle 11. The thus sucked weft yarn W is projected from the weft inserting nozzle 11 under cooperation of the air jet from the first air ejection nozzle 11*b* and the air jet from the second air ejection nozzle 11*c*, and flies toward the counter-weft picking side through the shed of the warp yarns Y under assistance of air jets from a plurality of auxiliary nozzles 20. When the breakage sensor 5 detects the presence of the weft yarn W, the weft yarn W is cut at a portion near the tip end of the weft inserting nozzle 11 by a cutter 41, while the weft yarn on the side of the warp yarn array is sucked into the suction pipe of the weft traction device 12 thereby removing the cut weft yarn. Then, air jet ejection in the weft threading nozzle 19 and in the second ejector nozzle 11*c* is stopped while setting the air ejection pressure of the first ejector nozzle 11*b* at a predetermined level required for weft picking during loom weaving operation. Additionally, the weft tensor 16 is brought into its weakly grasping condition, and the measuring pawl 10*c* is inserted into the drum 10*b*. Furthermore, the weft winding arm 10*a* is normally rotated, and the storage amount of the weft yarn W wound on the drum 10*b* is detected by a storage amount sensor 6. When the storage amount reaches a predetermined level over a level corresponding to one pick, the normal rotation of the weft winding arm 10*a* is stopped thus bringing the loom into a condition in which restarting is possible.

Figure 10:
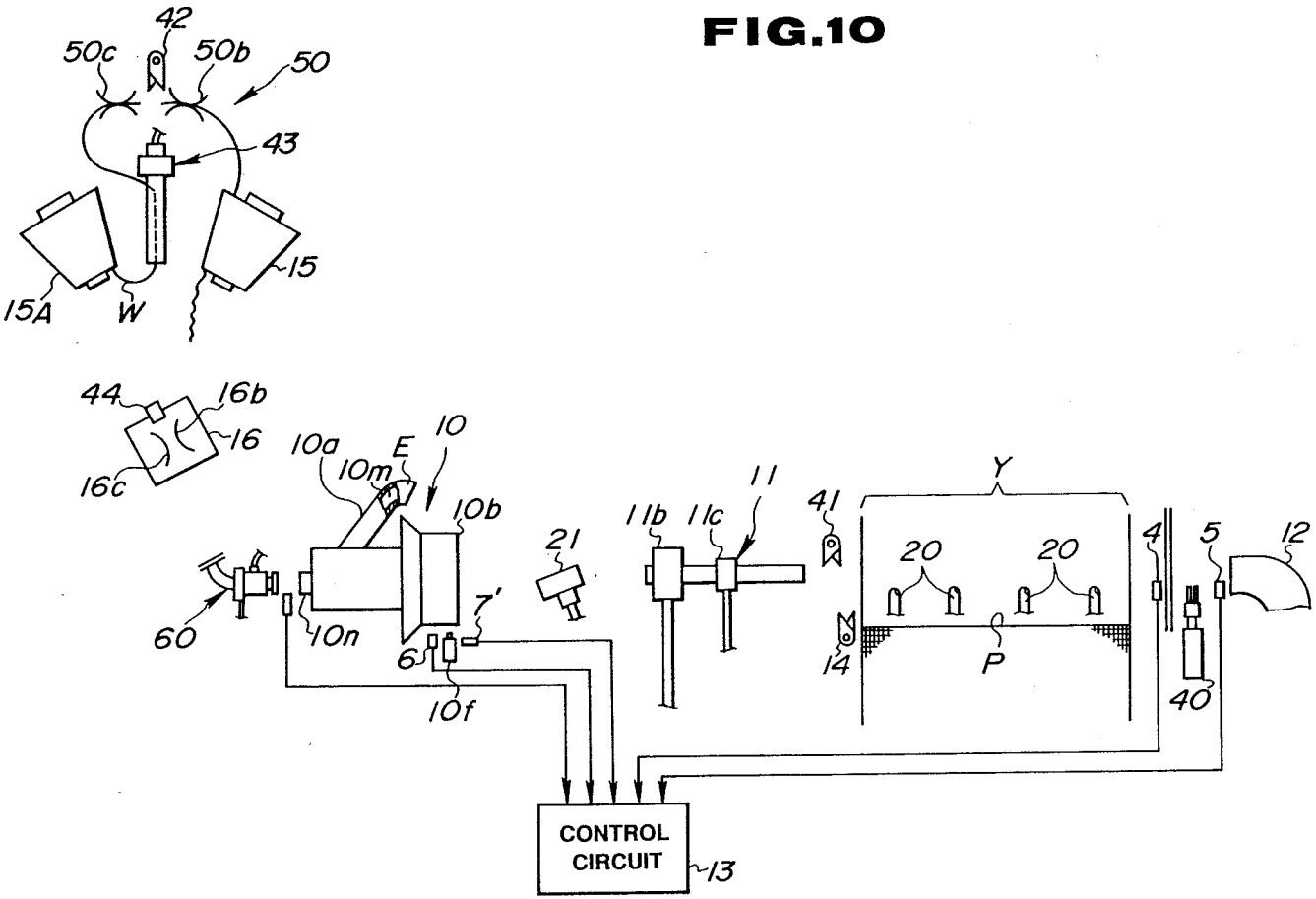
FIG. 10 is a schematic illustration of a modified embodiment of the second embodiment weft threading system, showing a state in which a faulty weft yarn has been removed.
Figure 11:
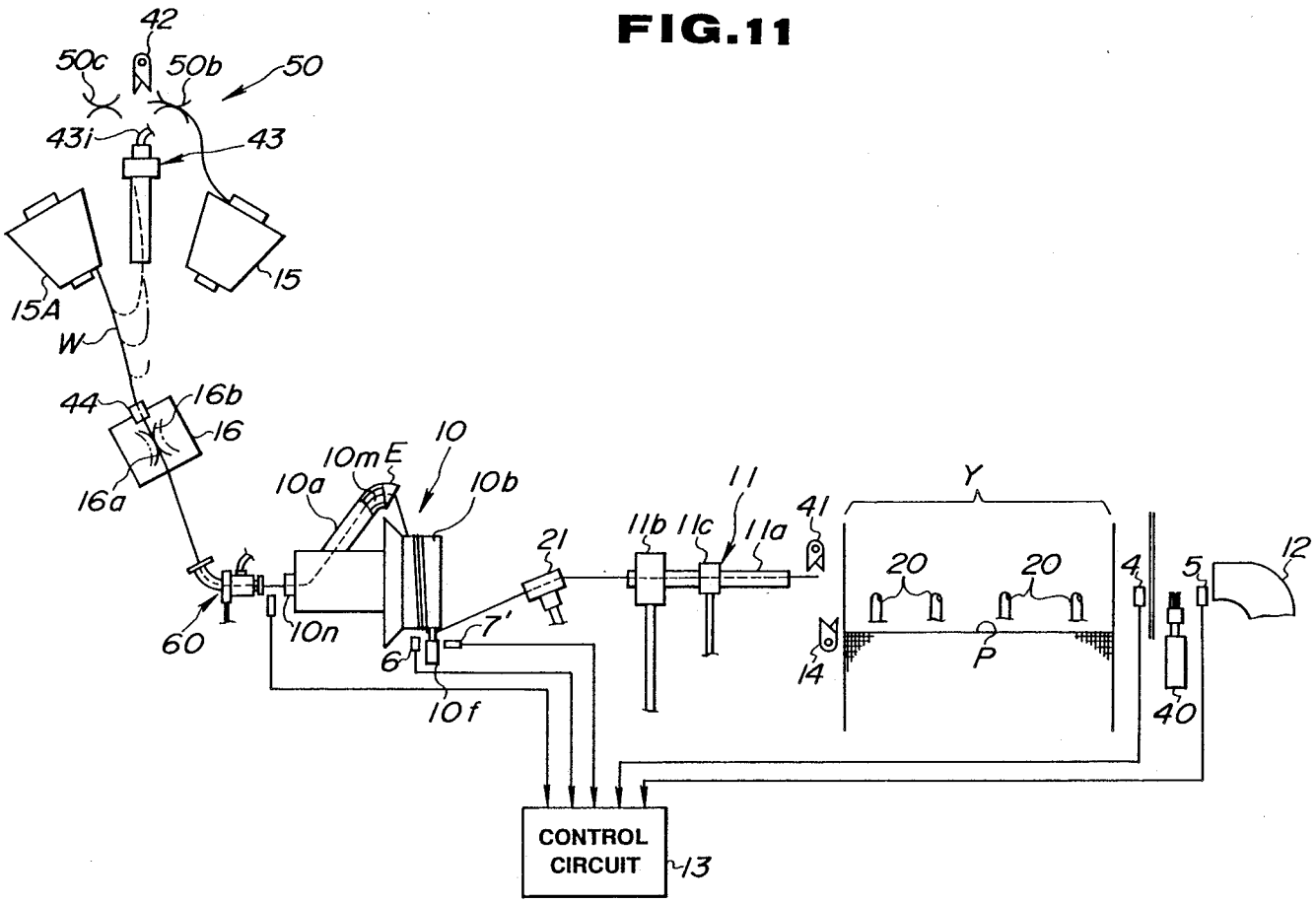
FIG. 11 is a schematic illustration similar to FIG. 10 but showing another state in which a weft yarn has been threaded through the path of the weft yarn.
Figure 12:
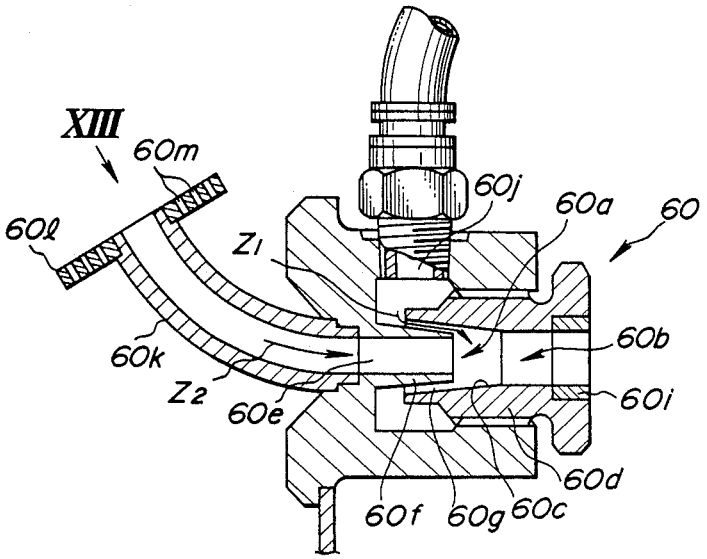
FIG. 12 is a longitudinal sectional view of a weft feeding device of the weft threading system of FIG. 10.
Figure 13:
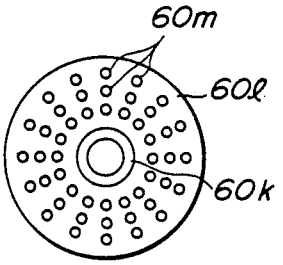
FIG. 13 is a plan view of an annular flange of the weft feeding device of FIG. 12, as viewed from the direction of an arrow XIII.

FIGS. 10 to 14 illustrate a modified embodiment of the second embodiment of FIGS. 4 to 9, which is similar to the second embodiment with the exception that a weft feeding device 60 is used in place of the weft feeding device F including the weft traction device 17 and the weft threading nozzle 19. As best shown in FIG. 12, the weft feeding device 60 includes a nozzle body 60*d* formed with an axial tapered hole 60*c*. A needle 60*c* formed with an axial weft introduction opening 60*c* is disposed within the axial tapered hole 60*c* of the nozzle body 60*d* in such a manner as to form a tapered annular air ejection opening 60*g* defined between the tapered outer surface of the needle 60*f* and the tapered inner surface of the nozzle body 60*d*. The thus formed air ejection opening 60*g* constitutes an ejector nozzle 60*a* through which an air jet is ejected. The nozzle body 60*d* is also formed with a flow straightener opening 60*b* which has the same diameter throughout its length. The flow straightener opening 60*b* smoothly connects with the tapered hole 60*c* and is located on the downstream side of the tapered hole 60*c* in the direction of flow of the air jet, i.e., on the side of the drive shaft 10*n* of the weft storage unit 10. Accordingly, suction in a direction indicated by an arrow $Z_2'$ is generated at the rear end section of the weft introduction opening 60*e* under the influence of the air jet ejected in a direction indicated by an arrow $Z_1'$. The flow straightener opening 60*b* functions to provide a directivity to air jet to be ejected from the nozzle body 60*d* so as to accurately direct the weft yarn W projected from the nozzle body 60*d* toward the weft passage 10*m* of the drive shaft 10*n*. A pipe 60*j* is fixedly secured to an outer body (no numeral) integral with the needle 60*f* and fluidly connected with the tapered air ejection opening 60*g* to supply pressurized air into the opening 60*g*. An annular guide member 60*i* is securely fitted at the weft outlet of the nozzle body 60*d*. Additionally, an upwardly bent weft guide pipe 60*k* is fixedly connected at its outlet side end to the weft inlet of the needle 60*f* in such a manner that the opening of the pipe 60*k* communicates with the weft introduction opening 60*e* of the needle 60*f*. The weft guide pipe 60*k* is provided at its inlet side end with an annular flange 60*l* formed with a plurality of small openings 60*m* as shown also in FIG. 13. The annular flange 60*l* is generally perpendicular to the axis of the weft guide pipe 60*k* at the inlet.

With the arrangement of this embodiment of FIGS. 10 to 13, during weft threading in a state of FIG. 11 which has come through a state of FIG. 10, the weft yarn W supplied through the weft tensor 16 is received by suction generated at the weft inlet of the weft feeding device 60 and sucked into the weft introduction opening 60*e* of the weft feeding device 60. Here, by virtue of a plurality of the openings 60*m* formed through the flange 60*l*, the air jet from the weft supply device 44 is effectively prevented from reflection on the surface of the flange 60*l*, thereby securely accomplishing transferring operation of the weft yarn W to the weft guide pipe 60*k*. The weft yarn W sucked into the weft feeding device 60 is securely fed to the weft passage 10*m* formed in the drive shaft 10*n* of the weft winding arm 10*a* under the influence of the air jet ejected from the weft feeding device 60. Thereafter, the weft yarn W passes through the weft passage 10*m* of the weft winding arm 10*a* and is then threaded through the weft guide 21 into the weft inserting nozzle 11 in the same manner as in the second embodiment. It will be appreciated that the weft supply device 44, the weft feeding device 60 and the weft guide 21 may be constructed and arranged like the weft inserting nozzle 11.

Figure 14A:
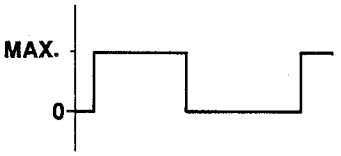
FIGS. 14A and 14B are graphs showing force of air jet stream from the weft feeding device of FIG. 12, in terms of variation of time.
Figure 14B:
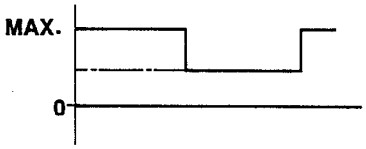

It is preferable to change with time the force of air jet ejected from the nozzle 43*b* of the weft threading storage device 43, the weft supply device 44, the weft threading nozzle 19 of the weft feeding device F and the weft guide 21. This can be achieved by intermittingly ejecting air jet so that the air jet force repeatedly takes the maximum value and zero value as shown in FIG. 14A. Otherwise, the same can be achieved by continuously ejecting air jet in such a manner that the air jet force repeatedly takes the so maximum value and a lower value which is slightly higher than the zero value. By changing the force of the air jet with time, the air jet ejected from an air ejection or nozzle device is prevented from reflection on the outer peripheral section of the weft inlet of a downstream side device, thereby improving the receiving function of the downstream side device.

Figure 15A:
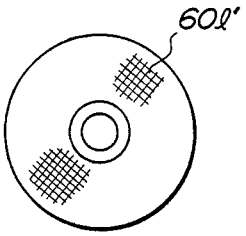
FIG. 15A is an axial front view of an essential part of a modified example of the weft feeding device of FIG. 12.
Figure 15B:
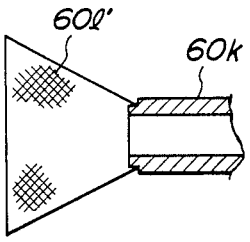
FIG. 15B is a fragmentary sectional view of the essential part of the modified example weft feeding device of FIG. 15A.

FIGS. 15A and 15B show a modified example of the weft feeding device 60 of FIG. 12. In this modified example, a frustoconical member 60*l'* formed of wire netting is fixed at its smaller diameter end section to the inlet end of the weft guide pipe 60*k* in place of the annular flange 60*l* of FIG. 12. It will be understood that the frustoconical wire netting member 60*l'* functions the same as in the annular flange 60*l* in FIG. 12.

It will be appreciated that the above-discussed weft threading systems may be used for preparation of initial starting operation, for example, in a loom weaving a fabric of yarns formed of glass fiber thereby making possible to automatically start weaving operation of such a loom, in which glass fiber yarns cannot be tied to each other and therefore are bonded with each other because of the characteristics of tending to break upon bending.

Figure 16:
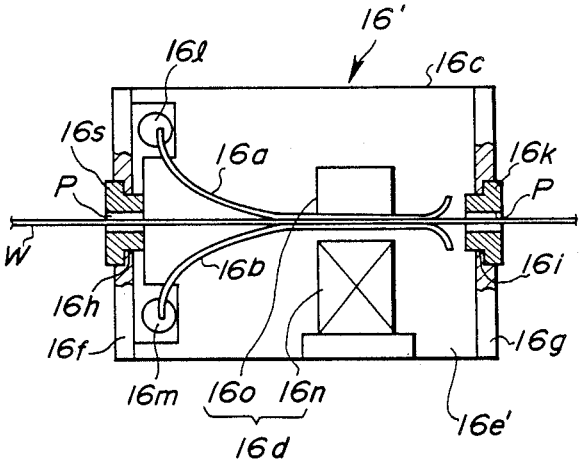
FIG. 16 is a plan view, partly in section, of another weft tensor usable in the first embodiment weft threading system of FIG. 1, showing an operational state.

FIGS. 16 to 19 show a weft tensor 16' which is usable in place of the tensor 16 in FIG. 1 and FIG. 7. The weft tensor 16' has a pair of grasping members 16*a*, 16*b* which are arranged to incorporate with each other to maintain the weft yarn W therebetween. The weft tensor 16' is adapted to selectively take the weakly grasping condition, the strongly grasping condition and the releasing condition. In the weakly grasping condition, the weft yarn W is weakly grasped so as to be possible to be drawn through the weft tensor 16 toward the weft storage unit 10 with some resistance. In the strongly grasping condition, the weft yarn W is strongly grasped so as to be impossible to be drawn through the weft tensor 16. In the releasing condition, the weft yarn W is not grasped so as to be possible to be freely drawn through the weft tensor 16. More specifically, as shown in FIG. 16, the weft tensor 16' includes a main body 16*c* on which the grasping members 16*a*, 16*b* are mounted and selectively take the above three conditions under action of a change-over device 16*d*. The main body 16*c* includes a base plate 16*e'* which is provided with left and right side walls 16*f*, 16*g* which are respectively formed with annular openings 16*h*, 16*i*. Generally cylindrical guides 16*k*, 16*s* provided with an annular flange are respectively fitted in the annular opening 16*h*, 16*i* of the side walls 16*f*, 16*g*, so that a weft introduction opening P(through which the weft yarn passes) is defined in each cylindrical guide 16*k*, 16*s*.

The grasping members 16*a*, 16*b* are assembled with the main body 16*c* in such a manner that the weft yarn W is passed through between the grasping members 16*a*, 16*b*. The grasping members 16*a*, 16*b* are formed of elongate leaf spring and are fixed at their rear end section to support shafts 16*l*, 16*m* which are adjustably fixed to the casing 16*e*. The front end section of each of the grasping members 16*a*, 16*b* are in contact with each other under a condition in which the grasping members 16*a*, 16*b* bias with each other so that the weft yarn W is passed through between the grasping members. In this arrangement, the grasping member 16*b* is made of non-magnetic material such as stainless steel. The change-over device 16*d* includes an electromagnet 16*n* located on the side of the non-magnetic grasping member 16*a* and installed to the base plate 16*e*. A permanent magnet 16*o* is installed to the back side of the other grasping member 16*b*.

The thus configurated weft tensor 16′ operates as follows:

(1) Under a condition in which electric current supply to the electromagnet 16*n* is interrupted, the grasping members 16*a*, 16*b* are brought into contact with each other in a biased condition under elasticity of the grasping members as shown in FIG. 16. As a result, the weft yarn W located between the grasping members 16*a*, 16*b* are weakly grasped to allow yarn to be drawn through the weft introduction openings P.

Figure 18:
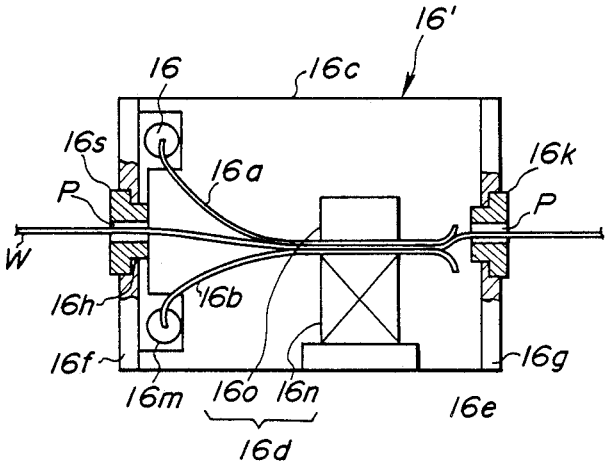
FIG. 18 is a plan view similar to FIG. 16 but showing another operational state of the weft tensor of FIG. 16.
Figure 19:
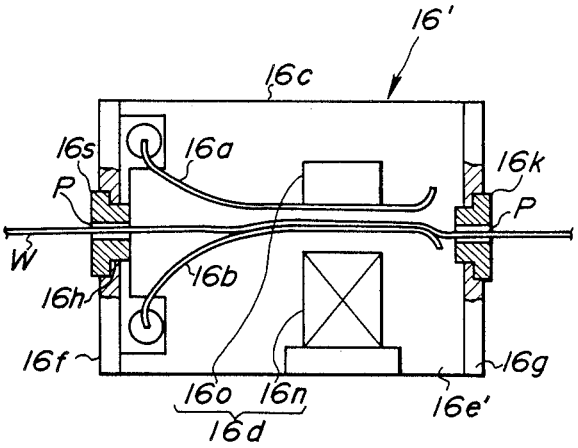
FIG. 19 is a plan view similar to FIG. 16 but showing a further operational state of the weft $ tensor of FIG. 16.

(2) When the electromagnet 16*n* is energized to attract the permanent magnet 16*o* upon electric current supply to the electromagnet 16*n*, the grasping members 16*a*, 16*b* are bent so that support shafts 16*l*, 16*m* serve as points of application, under a condition in which the permanent magnet 16*o* is attracted to the electromagnet 16*n* as shown in FIG. 18. Accordingly, the grasping members 16*a*, 16*b* are brought into strong press contact with each other. As a result, the weft yarn W located between the grasping members 16*a*, 16*b* is strongly grasped passing through the weft introduction openings P, in a condition in which the weft yarn W cannot be drawn from the weft tensor 16′.

(3) When electric current is supplied to the electromagnet 16*n* in a manner to flow in the reverse direction relative to in the case of 2), the electromagnet 16*n* repulses the permanent magnet 16*o* upon energization thereof. Then the grasping member 16*a* is bent so that the support shaft 16*l* serves as a point of application, in a direction far from the grasping member 16*b*. At this time, the grasping member 16*b* is in such a restored state that the support shaft 16*m* serves as a point of application, so that the grasping members 16*a*, 16*b* are separate from each other. As a result, the weft yarn W located between the grasping members 16*a*, 16*b* and passing through the weft introduction openings P is free from the grasping by the grasping members 16*a*, 16*b* so that the weft tensor 16′ is brought into the releasing condition.

Figure 20:
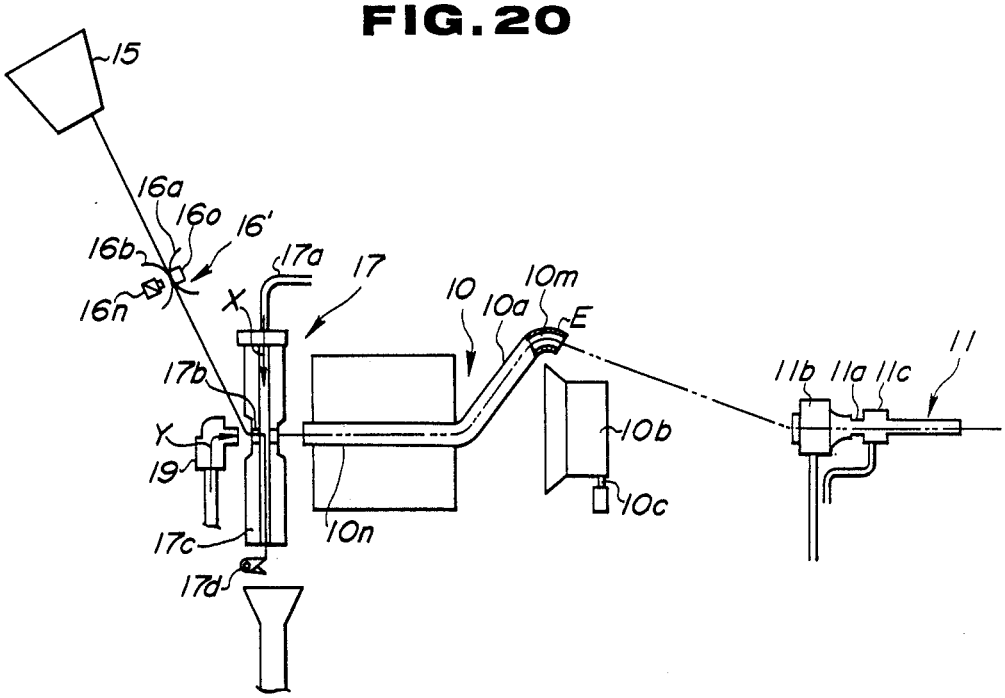
FIG. 20 is a schematic illustration of the weft threading system according to the present invention in which the weft tensor of FIG. 16 is used.

The above-configurated weft tensor 16′ is, for example, used in a third embodiment of the weft threading system as shown in FIG. 20 which is similar to that of FIG. 1 with the exception that the weft guide 21 disposed between the weft storage unit 10 and the weft inserting nozzle 11 is omitted. The operation of the weft tensor 16′ will be discussed in operation of the weft threading system with reference to FIG. 20.

When a mispick occurs during weaving operation of the loom, first the weft tensor 16′ is brought into its strongly grasping condition thereby to prevent the weft yarn W from being drawn out from the weft supply member 15. Then, the air jet is ejected from the nozzle 17*a* of the weft traction device 17 to blow the weft yarn W within the weft introduction opening 17*b* from the side direction or the direction indicated by an arrow X in FIG. 20. Simultaneously, the weft winding arm 10*a* is reversely rotated thereby unwinding the weft yarn W wound on the drum 10*b*. As the weft yarn W unwinds from the drum 10*b*, the weft yarn W strongly grasped by the weft tensor 16′ is blown into the pipe 17*c* under the influence of air jet from the nozzle 17*a*. When the weft yarn W is drawn and removed from the weft inserting nozzle 11 and the weft storage unit 10, the reverse rotation of the weft winding arm 10*a* is stopped so as to locate the weft winding arm 10*a* at a predetermined position while operating the cutter 17*d* to cut the weft yarn W which is sucked and projected downward of the pipe 17*c*. Thereafter, air ejection from the nozzle 17*a* is stopped, in which the weft yarn W is located as indicated by solid line in FIG. 20.

Subsequently, the weft tensor 16 is so operated to alternately take the weakly grasping condition (or releasing condition) and the strongly grasping condition while ejecting air is generated in the weft threading nozzle 19, in the weft guide 21 and in the weft inserting nozzle 11. In this air ejection, the weft treating nozzle 19 ejects air jet in a direction indicated by an arrow Y, and the weft guide 21 ejects air jet in the direction of the weft inserting nozzle 11. In the air ejection of the weft inserting nozzle, air ejection is made in the first and second ejector nozzles 11*b*, 11*c* thereby generating suction at the weft inlet or rear end section of the weft inserting nozzle main body 11*a*.

Accordingly, the weft yarn W supplied through the weft tensor 16′ from the weft supply member 15 and extended through the weft introduction opening 17*b* is passed into the weft passage 10*n* formed in the weft winding arm 10*a* under the influence of the air jet ejected from the weft threading nozzle 19 and projected from the tip end section E of the weft winding arm 10*a*. The weft yarn W from the weft winding arm 10*a* then reaches the vicinity of the weft inlet or rear end section of the weft inserting nozzle 11. Then, the weft yarn W is sucked into the weft introduction opening of the weft inserting nozzle 11 under vacuum generated at the vicinity of the weft inlet or rear end section of the weft inserting nozzle 11, and projected from the weft inserting nozzle 11 under the influence of a combination of air ejections from the first and second ejector nozzles 11*b*, 11*c*. The thus projected weft yarn W flies through the shed of the warp yarns Y toward the counter-weft picking side to accomplish a weft picking.

Thereafter, the weft tensor 16′ is brought into its weakly grasping condition while stopping air ejection in the weft threading nozzle 19 and in the second ejector nozzle 11*c*. Simultaneously, the air pressure in the first ejector nozzle 11*b* is set at a predetermined level for weft picking in weaving operation. Then, the measuring pawl 10*b* is inserted into the drum 10*b* and the weft winding arm 10*a* is normally rotated to wind the weft yarn WY on the drum 10*b*. When the wound amount of the weft yarn Y reaches a predetermined level over a level corresponding to one pick, the normal rotation of the weft yarn W is stopped thereby restarting the weaving operation of the loom. Thus, a series of treatment for the mispicked weft yarn W is completed.

Figure 17:
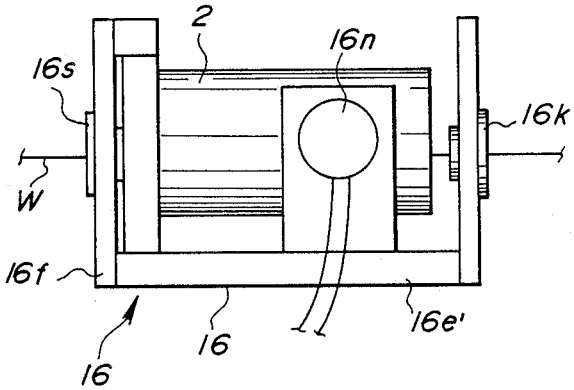
FIG. 17 is a side view of the weft tensor of FIG. 16.
Figure 21:
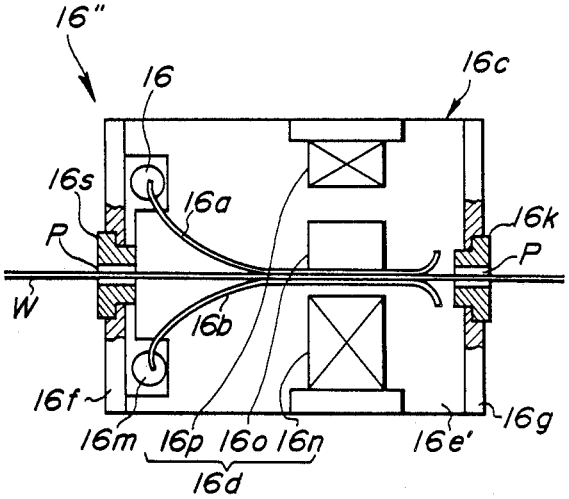
FIG. 21 is a plan view similar to FIG. 16 but showing a further weft tensor usable in place of the weft tensor of FIG. 16.

FIG. 21 shows a weft tensor 16″ similar to that of FIGS. 16 to 18 and usable in place of the weft tensor 16 in FIG. 1 and FIG. 7. In this weft tensor 6″, the change-over device 16*d* includes the first electromagnet 16*n* located on the side of the non-magnetic grasping member 16*b* and installed to the base plate 16*e*′. The permanent magnet 16*o* is installed to the back side of the other grasping member 16*a*. The second electromagnet 16*p* is disposed on the side of the permanent magnet 16*o* and installed to the base plate 16*e*′. The strongly grasping condition of the weft tensor 16″ is accomplished by supplying electric current to the first electromagnet 16n and by interrupting supply of electric current to the second electromagnet 16p. The weakly grasping condition of the weft tensor 16'' is accomplished by interrupting supply of electric current to both the first and second electromagnets 16n, 16p. The releasing condition of the weft tensor 16'' is accomplished by interrupting the supply of electric current and by supplying electric current to the second electromagnet 16b. Such a control manner for the weft tensor 16'' is shown in Table 3. Otherwise, the weft tensor 16'' may be controlled in the following manner: The first and second electromagnets 16n, 16p are respectively supplied with electric currents which are opposite in flow direction to each other thereby accomplishing the strongly grasping or releasing condition; and the supply of electric current to the first and second electromagnets 16n, 16p is interrupted thereby accomplishing the weakly grasping condition. Such a control manner for the weft tensor 16'' is shown in Table 4.

TABLE 3

| | Electric current | | |
|---|---|---|---|
| | 1st electro-magnet 16n | 2nd electro-magnet 16p | Operation |
| Strongly grasping condition | Supplied | Inter-rupted | Permanent magnet 16 is attracted to 1st electro-magnet 16n, so that grasping members 16a, 16b are in strong contact with each other. |
| Weakly grasping condition | Inter-rupted | Inter-rupted | Grasping members 16a, 16b are in contact with each other under elasticity of themselves. |
| Releas-ing condition | Inter-rupted | Supplied | Permanent magnet 11o is attracted to 2nd electro-magnet, so that grasping members 16a, 16b are separate from each other. |

TABLE 4

| | Electric current | | |
|---|---|---|---|
| | 1st electromagnet 16n | 2nd electromagnet 16p | Operation |
| Strongly grasping condition | Supplied | Supplied oppo-sitely in flow direction rela-tive to 1st electromagnet | Permanent magnet 16o is attracted to 1st electro-magnet 16n while repulsed to 2nd electromagnet 16p, so that grasping members 16a, 16b are in strong contact with each other. |
| Weakly grasping condition | Interrupted | Interrupted | Grasping members 16a, 16b are in contact with each other under elasticity of themselves. |
| Releasing condition | Supplied oppositely in flow direction relative to 1st electromagnet in strongly grasping condition | Supplied oppositely in flow direction relative to 1st electromagnet in releasing condition | Permanent magnet is repulsed to 1st electro-magnet 16n while attracted to 2nd electromagnet 16p, so that grasping members 16a, 16b are separate from each other. |

TABLE 4-continued

| | Electric current | | |
|---|---|---|---|
| | 1st electromagnet 16n | 2nd electromagnet 16p | Operation |

Accordingly, with the thus configurated weft tensor 16'', when the grasping members 16a, 16b are brought into the releasing condition for the weft yarn W, the second electromagnet 16p attracts the permanent magnet 16o and therefore the distance between the separated grasping members 16a, 16b can be larger without raising the magnetic force of the electromagnet as compared with the case of FIGS. 16 to 19. As a result, during threading of the weft yarn W into between the separated grasping members 16a, 16b, the weft yarn W can be effectively prevented from contacting with the grasping members 16a, 16b, thereby accomplishing smooth weft threading operation from the weft introduction opening P in the guide 16s to the weft introduction opening P in the guide 16k.

While the weft tensors 16', 16'' have been shown and described as being of the electromagnetically operated type, it will be understood that they may be replaced with that of the pneumatically operated type or the mechanically operated type. Additionally, it will be understood that the weft tensors 16', 16'' is usable with a water jet loom. Furthermore, it will be appreciated that the weft tensor 16', 16'' may be disposed between the weft storage unit 10 and the weft inserting nozzle 11.

Figure 22:
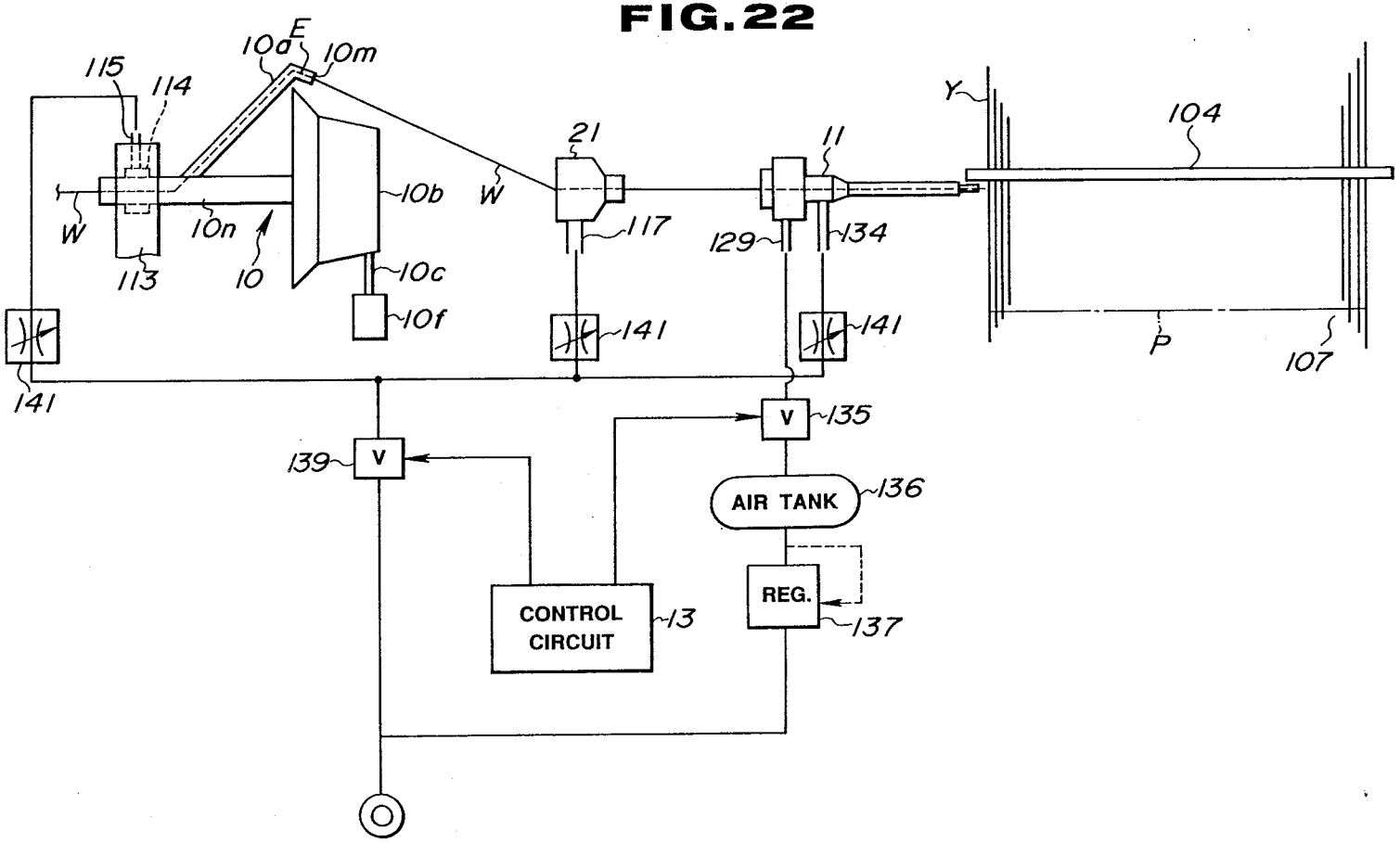
FIG. 22 is a schematic illustration of a fourth embodiment of the weft threading system according to the present invention.
Figure 23:
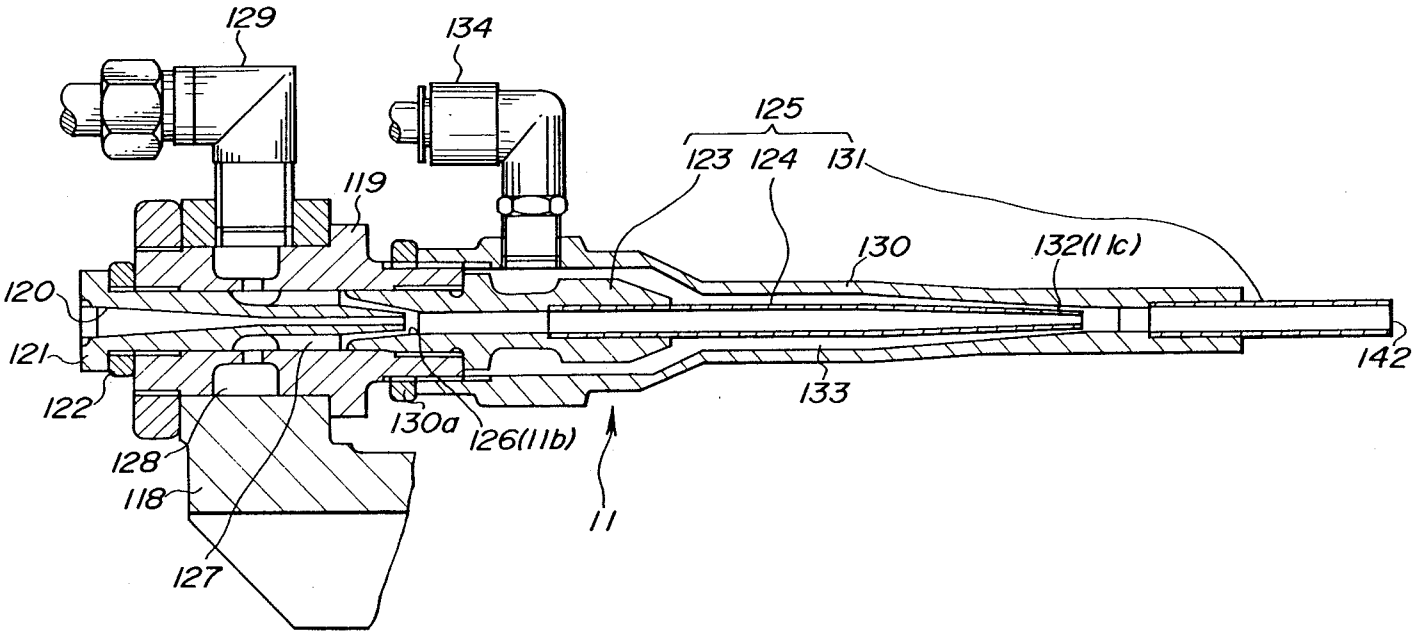
FIG. 23 is a longitudinal cross-sectional view of an example of a weft inserting nozzle used in the system of FIG. 22.

FIGS. 22 and 23 illustrate a fourth embodiment of the weft threading system according to the present invention, which is similar to the first embodiment of FIG. 1. In this embodiment, the drive shaft 10n of the weft storage unit 10 is rotatably supported by a bearing member 113. The bearing member 113 is formed with an air chamber 114 communicated with the weft passage 10m formed in the drive shaft 10n and the weft winding arm 10a, so that pressurized air is introduced from the air chamber 114 to the weft passage 10m to be ejected from the tip end section E of the weft winding arm 10a. An air jet ejected from the weft winding arm tip end section E is directed to the weft inlet or rear end section of the weft guide 21 disposed between the weft storage unit 10 and the weft inserting nozzle 11. In this embodiment, when the pressurized air is supplied to the air chamber 114, it is simultaneously supplied through an air pipe 117 to the nozzle section (not shown) of the weft guide 21. The weft inserting nozzle 11 is fixedly mounted on a reed holder (not shown) on which a reed 104 is also fixedly mounted, so as to be move with the reed 104 as a one-piece member. The reed 104 moves toward and strikes against the cloth fell P of a woven fabric 107.

FIG. 23 shows an example of the weft inserting nozzle 11 of the weft threading system of FIG. 22. The weft inserting nozzle 11 includes a generally cylindrical nozzle body 119 in which a weft introduction pipe 121 is fitted therein upon being inserted from the side or front end section of the cylindrical nozzle body 119 and fixed in position by means of a lock nut 122. A generally pipe-shaped holder 123 is screwed into and coaxially connected to the other or front end section of the nozzle body 119. A guide pipe 124 is fixedly coaxially connected to or held by the holder 123. A first annular air ejection opening 126 constituting the first ejector nozzle 11*b* is formed between the outer surface of the tapered tip end section of the weft introduction pipe 121 and the tapered inner surface of the rear end section of the holder 123. This first annular air ejection opening 126 functions to eject air jet mainly for the purpose of picking the weft yarn and is fluidly connected through an air passage 127 and a chamber 128 with an air supply pipe line 129.

An outer cylinder 130 is coaxially mounted on the front end section of the nozzle body 119 in such a manner that the nozzle body 119 is screwed into the outer cylinder 130, and is fixed in position by means of a lock nut 130*a*. The outer cylinder 130 is provided at its tip end section with a nozzle top 131 though which the air jet is ejected to pick the weft yarn W. The holder 123, the guide pipe 124 and the nozzle top 131 constitute a weft projection pipe 125. Additionally, a second air ejection opening 132 constituting the second ejector nozzle 11*c* is formed between the outer surface of the tapered tip end section of the guide pipe 124 and the tapered inner surface of the outer cylinder 130. The second air ejection opening 132 functions to eject the air jet mainly for the purpose of threading the weft yarn into the weft inserting nozzle 11. The second air ejection opening 132 is fluidly connected through an air passage 33 with an air supply pipe line 134.

As shown in FIG. 22, the pipe line 129 for the first air ejection opening 126 is provided with a valve 35 of the open and close type, an air tank 136 and an air pressure regulator 137, and is fluidly connected with a pressurized air source 138. The pipe line 134 for the air ejection opening 132 is fluidly connected with the air supply pipe line 115 which is fluidly connected through an electromagnetic valve 139 to the pressurized air source 138. The open and close type valve 35 and the electromagnetic valve 139 are controlled to be opened and closed by the control circuit 13. The reference numeral 141 designates a variable aperture by which the flow amount of pressurized air is variably controlled.

The manner of operation of the fourth embodiment weft threading system will be discussed hereinafter.

During normal operation of the loom, the weft yarn W is wound on the drum 10*b* of the weft storage unit 10 and is previously passed into the weft inserting nozzle 11. In this state, after the valve 135 is opened at a predetermined operational angle of the loom main shaft to eject the air jet from the first air ejection opening 126, the measuring pawl 10*c* is withdrawn from the drum 10*b*. Accordingly, the weft yarn W is picked into the shed of the warp yarns Y while being drawn out from the drum 10*b*. When timing reaches a time point near completion of weft picking, the valve 135 is closed at a predetermined operational angle of the loom main shaft, and then the measuring pawl 10*c* is inserted into the drum 10*b* thereby preventing the weft yarn W from being drawn out of the drum 10*b* thus completing the weft picking.

When mispick occurs by any reason such as breakage of the weft yarn W on the drum 10*b*, the operation of the loom is stopped. At this time, the weft yarn W is not passed into the weft inserting nozzle 11 and therefore weft yarn W on the drum 10*b* is removed by an operator or a robot. Thereafter, it will be necessary to make preparation of restart of the loom upon newly winding the weft yarn W on the drum 10*b*.

In order to make such a preparation, first the reed 104 is manually or automatically adjusted so that the axis of the weft guide 21 is aligned with the axis of the weft inserting nozzle 11. Then the electromagnetic valve 139 is opened to eject pressurized air through the weft passage 10*m* of the weft winding arm 10*a*, in the weft guide 21 and from the second air ejection opening 32 of the weft inserting nozzle 11. In this condition, when a tip end section of the weft yarn W drawn out from the weft supply member (not shown) is brought to the weft inlet or rear end section of the drive shaft 10*n*, the weft yarn W is sucked into the weft passage 10*m*formed in the drive shaft 10*n* and the weft winding arm 10*a*. Then, the weft yarn W is passed through the weft winding arm 10*a* and is projected from the tip end section E of the weft winding arm 10*a*. Thus projected weft yarn W is blown to the vicinity of the weft inlet or rear end section of the weft guide 21 and is then sucked into the weft guide 21 under suction generated due to air ejection in the weft guide 21. Accordingly, the weft yarn W from the weft winding arm 10*a* is carried through the weft guide 21 to the weft inlet of the weft introduction opening 120 of the weft inserting nozzle 11. In this weft inserting nozzle 11, an air stream flowing from the weft introduction opening 120 to the nozzle top 131 is generated and therefore the weft yarn W from the weft guide 21 is threaded into the weft inserting nozzle 11 to reach the nozzle top 131. At this time, only a vacuum is prevailing in the weft projection pipe 125 between the first and second air ejection openings 126, 132 because of the fact that the second air ejection opening 132 is located near the nozzle outlet opening 142 as compared with the first air ejection opening 126. Accordingly, even if the air pressure of pressurized air ejected from the second air ejection opening 132 is raised to increase suction of the weft inlet of the weft introduction pipe 121, the weft yarn W located within the weft projection pipe 125 is prevented from breakage, thus obtaining a sufficient length of the weft yarn required for the next weft picking within the weft projection pipe 125.

While the above embodiment has been shown and described as being arranged so that weft yarn W is carried to the weft inlet of the weft introduction opening 20 of the weft inserting nozzle 11 under the influence of the air stream, it will be understood that the weft yarn W may be carried to the weft inlet of the weft introduction opening 20 by an operator or by a so-called magic hand.

Figure 24:
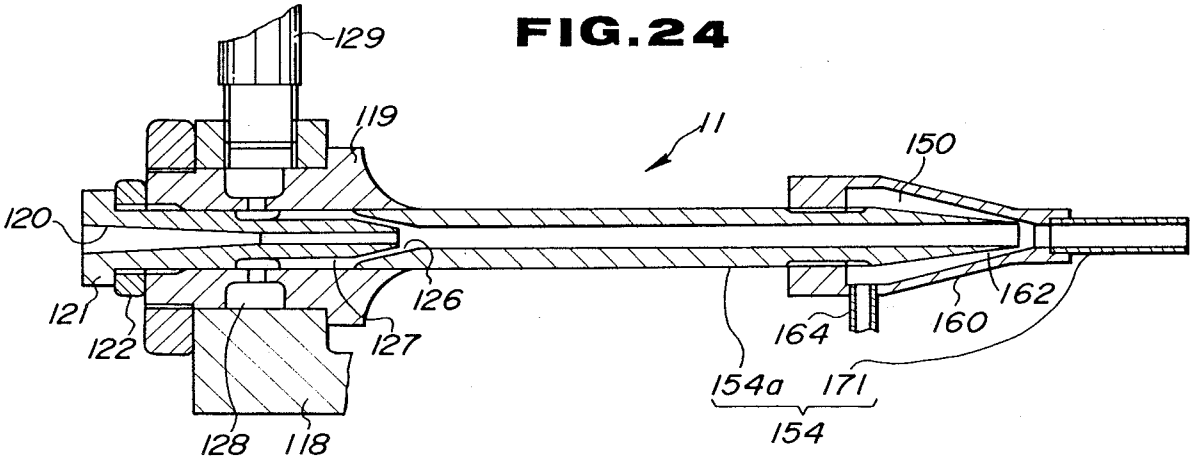
FIG. 24 is a longitudinal cross-sectional view similar to FIG. 23 but showing another example of the weft inserting nozzle.

FIG. 24 shows a modified example of the weft inserting nozzle 11, which is similar to the weft inserting nozzle of FIG. 23. In this example, a guide pipe 154*a* is fixedly secured in and coaxially connected with the nozzle body 119 so that the first air ejection opening 126 is formed between the outer surface of the tapered tip end section of the weft introduction pipe 121 and the inner tapered surface of the guide pipe 154*a*. A tapered outer pipe 160 is disposed around the tapered tip end section of the guide pipe 154*a* in such a manner as to slightly project from the tip end of the guide pipe 154*a*. Accordingly, a second air ejection opening 162 constituting the second ejector nozzle 11*c* is formed between the outer surface of the tapered tip end section of the guide pipe 154*a* and the tapered inner surface of the outer pipe 160. The outer pipe 160 is provided at its tip end with a relatively short nozzle top 171. The guide pipe 154*a* and the nozzle top 171 constitute a weft projection pipe 154. A chamber 150 defined between the guide pipe 154*a* and the outer pipe 60 is supplied with pressurized air through a pipe line 64.

Figure 25:
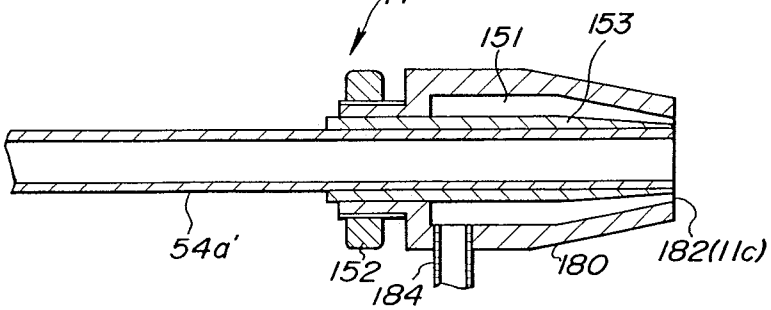
FIG. 25 is a fragmentary longitudinal cross-sectional view of a further example of the weft inserting nozzle.

FIG. 25 shows another modified example of the weft inserting nozzle 11 similar to the weft inserting nozzle of FIG. 24. In this example, the guide pipe 54*a*′ is formed cylindrical so as to have the same outer diameter throughout the length. A cylindrical sleeve 153 is fixedly mounted on the tip end section of the guide pipe 154*a*′. A tapered outer cylinder 180 is disposed on the sleeve 153 in such a manner that the tip end faces of the outer cylinder 180 and the guide pipe 154*a*′ are flush with each other. Accordingly, a second air ejection opening 182 constituting the second ejector nozzle 11*c* is formed between the tip end faces of the outer cylinder 180 and the guide pipe 154*a*′. The outer cylinder 180 is fixed in position on the sleeve 153 by means of a lock nut 152. A chamber 51 defined between the sleeve 153 and the outer cylinder 180 is supplied with pressurized air through a pipe line 184.

Figure 26:
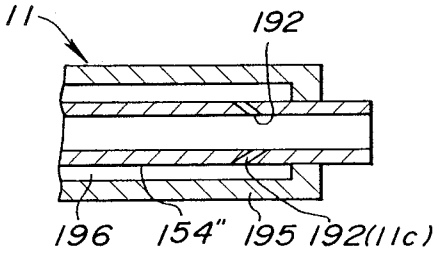
FIG. 26 is a fragmentary longitudinal cross sectional view of a further example of the weft inserting nozzle.

FIG. 26 shows a further modified example of the weft inserting nozzle 11 similar to the weft inserting nozzle of FIG. 25. In this example, the tip end section of the guide pipe 154″ is covered with an outer cylinder 195 in such a manner that the guide pipe 154″ slightly projects from the tip end of the outer cylinder 195. Additionally, the guide pipe 154″ is formed at its tip end section with a plurality of second air ejection openings 192 which obliquely extend relative to direction of weft picking. Accordingly, pressurized air supplied to a chamber 196 defined between the guide pipe 154″ and the outer cylinder 195 is ejected through the second air ejection openings 192 into the inside opening of the guide pipe 54″.

FIGS. 27 to 30 illustrate a fifth embodiment of the weft threading system of the present invention, similar to the first embodiment weft threading system of FIG. 1. This embodiment is arranged to operate in brief as follows: When mispick occurs under breakage of the weft yarn W which is flying through the shed of warp yarns Y, the breakage sensor 5 disposed on the inlet side of the pipe of the weft traction device 12 detects presence of the warp yarn Wb (the upstream section of the broken weft yarn W) and outputs to the control circuit 13 a breakage signal $Q_1$ representing the presence of the broken weft yarn Wb, so that the control circuit 13 detects the mispick. Then the control circuit 13 operates to stop cutting operation of a normally operated cutter 14 for cutting the picked weft yarn W to have a predetermined length, i.e., stops cutting function of the loom. Thereafter, the control circuit 13 outputs a control command $K_1$ to stop a main shaft (not shown) of the loom, i.e., to stop revolution of the loom. The main shaft of the loom is driven by a motor so that a variety of moving elements and parts of the loom are operated in timed relation to and in accordance with rotation of the main shaft. The rotation of the main shaft is usually stopped at the next weaving cycle relative to the weaving cycle in which the mispick occurs. After lapse of a time duration from detection of the mispick to the complete stopping of loom weaving operation, the control circuit 13 outputs a control command $K_2$ in response to which the loom main shaft starts its reverse (direction) rotation at a speed lower than in its normal (direction) rotation. This reverse rotation of the loom main shaft is stopped at a timing at which the reed 104 is located at its limit position in backward movement in the weaving cycle in which the mispick occurs while the shed opening of the warp yarns Y becomes the maximum, in response to a control command $K_3$ from the control circuit 13. Upon such reverse rotation of the loom main shaft, the upper and lower arrays of the warp yarns Y are alternately replaced with each other so that the mispicked weft yarn Wa leading the weft inserting nozzle 11 and the broken weft yarn Wb separate from the yarn Wa are exposed at the cloth fell P of a woven fabric. Then the control circuit 13 outputs a control command $K_4$ to operate the weft traction device 12 under suction due to air stream, so that the downstream side end section of the broken weft yarn Wb is sucked into the weft traction device 12.

Figure 27:
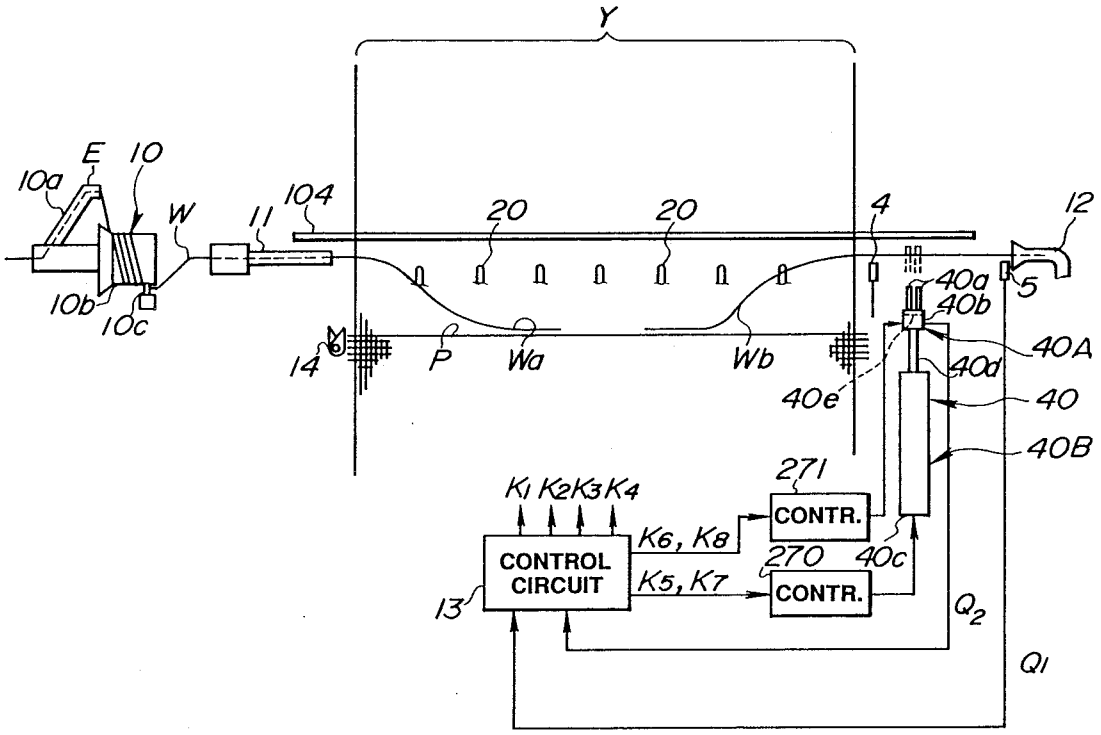
FIG. 27 is a schematic illustration of a fifth embodiment of the weft threading system incorporated with a loom, in accordance with the present invention.
Figure 28:
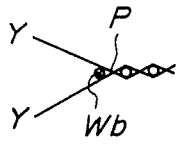
FIG. 28 is a fragmentary sectional view of an essential part of the loom, showing a state in which a picked weft yarn is exposed at a cloth fell.
Figure 29:
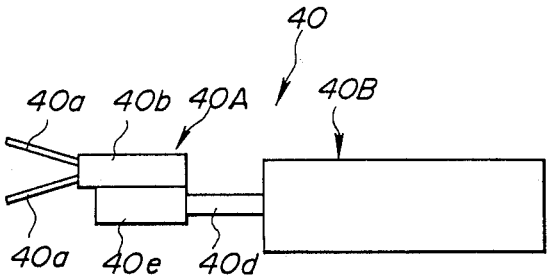
FIG. 29 is a side view of an essential part of the loom of FIG. 27.
Figure 30:
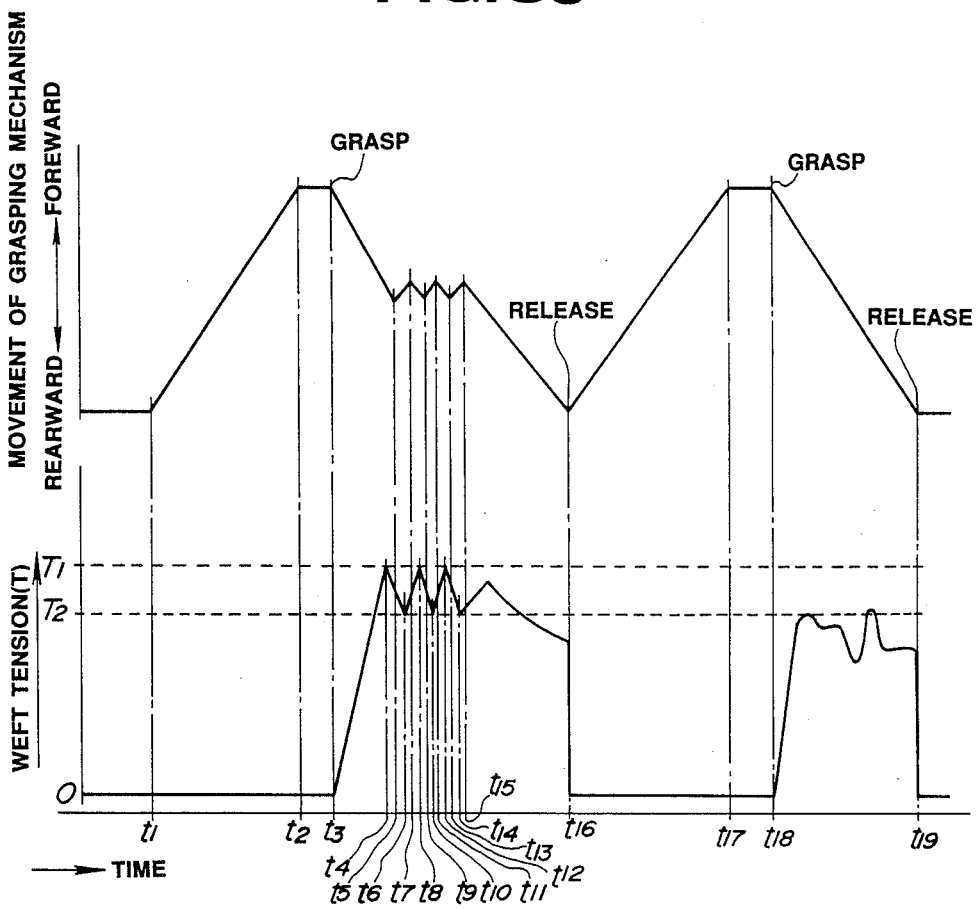
FIG. 30 is a graph showing an operational manner of an essential part of the loom of FIG. 27.

As shown in FIG. 27, a grasping-type weft traction device 40 is provided between the counter-weft picking side edge of the woven fabric and the weft traction device 12. The weft traction device 40 functions to grasp and pull the broken weft yarn Wb and is generally constituted of a grasping mechanism 40A and a driving mechanism 40B. The grasping mechanism 40A is adapted to grasp and release the broken weft yarn Wb and includes a pair of arms 40*a* which are driven to separate from and contact with each other by an actuator 40*b*. The driving mechanism 40 includes a hydraulically or pneumatically operated cylinder 40*c* which is fixedly secured to a side frame (not shown) of the loom. The cylinder 40*c* has an operating or piston rod 40*d* to which the actuator 40*b* is installed through a weft tension sensor 40*e* so that the tension of the weft yarn Wb is sensed by the weft tension sensor 40*e*. Under extension and contraction operation of the cylinder 40*c* with the piston rod 40*d*, the grasping mechanism 40A moves between its grasping position as indicated by dash-dot line and its withdrawal position as indicated by solid line in FIG. 27. Additionally, the grasping mechanism 40A can vibrate in response to a tension T applied to the broken weft yarn Wb and relative to a predetermined value. In this embodiment, the grasping mechanism 40A is arranged to make its twice reciprocal movements while grasping the broken weft yarn Wb during a time period from $t_1$ to $t_{19}$ as shown in FIG. 30.

More specifically, for the first reciprocal movement of the grasping mechanism 40A during a time period of from $t_1$ to $t_{16}$, a control command $K_5$ is output from the control circuit 13 to a controller 270 for the cylinder 40*c*. In response to control operation of the controller 270, the cylinder 40*c* extends during the time period so that the operating rod 40*d* projects outwardly. Accordingly the grasping mechanism 40A having the arms 40*a* in their separate state advances from the withdrawal position to the grasping position in such a manner that the arms 40*a* are inserted from the side direction into between the warp yarn array and the suction pipe of the weft traction device 12 under a state in which the broken weft yarn Wb is located between the arms 40*a*. When the grasping mechanism 40A stops at its grasping position, a control command $K_6$ is output from the control circuit 13 to a controller 271. In response to control operation of the controller 271, the actuator 40*b* operates to cause the arms 40*a* to contact with each other during a time period of from $t_2$ to $t_3$, thereby to grasp the broken weft yarn Wb. After lapse of the time in which the broken weft yarn Wb is grasped, a control command $K_7$ is output from the control circuit 13 to the controller 271 and therefore the cylinder 40*c* contracts so that the operating rod 40*d* withdraws during a time period of from $t_3$ to $t_{16}$. As a result, the grasping mechanism 40A under a state in which the arms 40*a* are grasping the broken weft yarn Wb is driven from its grasping position to its withdrawal position. In response to this backward movement of the grasping mechanism 40A, the tension T is applied to the broken weft yarn Wb during which relative movement is made between the grasping mechanism 40A and the operating rod **40*d* in the direction to separate from each other. In response to this relative movement, the weft tension tensor 40*e* generates and outputs a tension detection signal $Q_2$ representative of magnitude of electrical amount corresponding to the relative movement of the grasping mechanism 40A and the operating rod 40*d*. When the tension detection signal $Q_2$ reaches a predetermined upper limit value $T_1$ at a time $t_4$,the control command $K_5$ is output from the control circuit 13 to the controller 270 thereby to drive the cylinder 40*c* to extend at a time $t_5$ so that the grasping mechanism 40A moves forward or in the direction of the grasping position of the grasping mechanism 40A. When the tension detection signal $Q_2$ reaches a predetermined lower limit value $T_2$ at a time $t_6$ upon the extension of the cylinder 40*c* or the forward movement of the grasping mechanism 40A, a control command $K_7$ is output from the control circuit 13 to the controller 270 at a time $t_7$ thereby to contract the cylinder 40*c* so that the operating piston 40*d* withdraws. When the tension detection signal $Q_2$ reaches the predetermined upper limit value $T_1$ at a time $t_8$ upon contraction of the cylinder or withdrawal movement of the operating rod 40*d*, the control command $K_5$ is output from the control circuit 13 to the controller 270 at a time $t_9$ thereby extending the cylinder 40*c* or forwardly moving the operating rod 40*d*. When the tension detection signal $Q_2$ reaches the predetermined lower limit value $T_2$ at a time $t_{10}$ upon the extension of the cylinder 40*c*, the control command $K_7$ is output from the control circuit 13 to the controller 270 at a time $t_{11}$ thereby to contract the cylinder 40*c* or withdraw the operating rod 40*d*. When the tension detection signal $Q_2$ reaches the predetermined upper limit value $T_1$ at a time $t_{12}$ upon the contraction of the cylinder 40*c*, the control command $K_5$ is output from the control circuit 13 to the controller 270 at a time $t_{13}$ thereby to extend the cylinder 40*c* or to project the operating rod 40*d*. When the tension detection signal $Q_2$ reaches the predetermined lower limit value $T_2$ at a time $t_{14}$ upon the extension of the cylinder 40*c* or the projection of the operating rod 40*d*, the control command $K_7$ is output from the control circuit 13 to the controller 270 at a time $t_{15}$ thereby to contract the cylinder 40*c* or withdraw the operating rod 40*d*. In accordance with this contraction of the cylinder 40*c*, the tension detection signal reaches a peak value at a time $t_{16}$; however, this peak value is lower than the predetermined upper limit value $T_1$. As a result, the cylinder 40*c* continues to contract and brings to a condition in which the operating piston 40*d* reaches its withdrawal limit position at a time $t_{16}$, so that the grasping mechanism 40A returns to its withdrawal position. Then, a control command $K_8$ is output from the control circuit 13 to the controller 271, so that the actuator 40*b* operates to cause the arms 40*a* to separate from each other in response to the control operation of the controller 71, thus releasing the broken weft yarn Wb. In a process in which the grasping mechanism 40A backwardly move from its grasping position to its withdrawal position upon grasping the broken weft yarn Wb by the driving mechanism 40B during the time period of from $t_3$ to $t_{16}$, the grasping mechanism 40A** moves in a vibrating manner relative a standard value of the tension T applied to the broken weft yarn Wb, i.e., repeats its forward and backward movements relative to the predetermined upper and lower limit values $T_1$, $T_2$ as discussed above.

For the second reciprocal movement of the grasping mechanism 40A during a time period of from $t_{16}$ to $t_{19}$, the control command $K_5$ is output from the control circuit 13 to the controller 270 for the cylinder **40*c*. In response to control operation of the controller 270, the cylinder 40*c* extends during a time period of from $t_{16}$ to $t_{17}$ so that the operating rod 40*d* projects outwardly and accordingly the grasping mechanism 40A having the arms 40*a* in their separate state advances from the withdrawal position to the grasping position in such a manner that the arms 40*a* are inserted from the side direction into between the warp yarn array and the suction pipe of the weft traction device 12 under a state in which the broken weft yarn Wb is located between the arms 40*a*. When the grasping mechanism 40A stops at its grasping position, the control command $K_6$ is output from the control circuit 13 to the controller 271. In response to control operation of the controller 71, the actuator 40*b* operates to cause the arms 40*a*to contact with each other during a time period of from $t_{17}$ to $t_{18}$, thereby to grasp the broken weft yarn Wb. After lapse of the time in which grasping the broken weft yarn Wb is completed, the control command K is output from the control circuit 13 to the controller 271 and therefore the cylinder 40*c* contracts so that the operating rod 40*d* withdraws during a time period of from $t_{18}$ to $t_{19}$. As a result, the grasping mechanism 40A under a state in which the arms 40*a* are grasping the broken weft yarn Wb is driven from its grasping position to its withdrawal position. In response to this backward movement of the grasping mechanism 40A, the weft tension sensor 40*e* generates and outputs the tension detection signal $Q_2$ to the control circuit 13, in which it is assumed that the level of the tension detection signal $Q_2$ is lower than the predetermined upper limit value $T_1$ Accordingly, the cylinder 40*c* continues to contract and is brought into a condition in which the operating rod 40*d* reaches its withdrawal limit at a time $t_{19}$ so that the grasping mechanism 40A returns to its withdrawal position. Then, the control command $K_8$ is output from the control circuit 13 to the controller 271, so that the actuator 40*b* operates to cause the arms 40*a*** to separate from each other, thereby to release the broken weft yarn Wb.

With the thus configurated embodiment, when the picked weft yarn W is broken or cut during weaving operation of the loom as shown in FIG. 27, the loom weaving operation is stopped and then reverse revolution of the loom is made to cause the broken weft yarn Wb to be exposed at the cloth fell P of the array of the warp yarns Y. At this time, the front end section (on the counter-weft picking side) of the broken weft yarn Wb is sucked into the suction pipe of the weft traction device 12, while the rear end section (on the weft picking side) of the same bites into the cloth fell P under a condition that the broken weft yarn Wb is connected from the cloth fell P to the weft traction device 12. In this state, the grasping type weft traction device 40 operates so that the grasping mechanism 40A makes its twice reciprocal movements each movement being between its withdrawal position and its grasping position under the action of the driving mechanism 40B. In the process of the twice reciprocal movements of the grasping mechanism 40A, the grasping mechanism 40A advances from the withdrawal position to the grasping position to grasp the broken weft yarn Wb, and thereafter it moves backward from the grasping position to the withdrawal position, grasping the broken weft yarn Wb. As the grasping mechanism 40A moves backward, the rear end section of the broken weft yarn Wb whose front end section is sucked by the weft traction device 12 is extracted from the cloth fell P to the counter-weft picking side, removing the biting-in condition of the broken weft yarn Wb. At the withdrawal position, the grasping mechanism 40A releases the broken weft yarn Wb, so that the broken weft yarn Wb is sucked into the suction pipe of the weft traction device 12 on the counter-weft picking side. Thus, the broken weft yarn Wb is removed from the array of the warp yarns Y. Additionally, during the twice backward movements of the grasping mechanism 40A, the grasping mechanism 40A makes its forward and backward movements finely, i.e., vibrates within a range of from the predetermined upper and lower limit values $T_1$, $T_2$ of the tension T which is applied to the broken weft yarn Wb and detected by the weft tension sensor **40*e*. Such vibration of the grasping mechanism 40A facilitates removal of the biting-in condition of the broken weft yarn Wb to the cloth fell P. The faulty weft yarn Wa connected to the weft inserting nozzle 11 is manually removed by an operator or otherwise drawn from the cloth fell P by reversely rotating the weft winding arm 10*a* around the drum 10. Thereafter, the weft yarn W is threaded from the weft winding arm 10*a* into the weft inserting nozzle 11. It will be understood that the air jet is ejected from the tip end section E of the weft winding arm 10*a* toward the weft inlet of the weft inserting nozzle 11**. Upon completion of such weft threading operation, weaving operation of the loom is restarted.

While the predetermined lower limit value $T_2$ of the tension T applied to the broken weft yarn Wb has been shown and described as being set regardless of the predetermined upper limit value $T_1$, it will be understood that the predetermined lower limit value $T_2$ may be a tension value which is at a time slightly after a time at which the tension has reached the predetermined upper limit value $T_1$.

Thus, according to the above-discussed fifth embodiment, the faulty or mispicked weft yarn whose leading end has reached the counter-weft picking side can be effectively extracted from the shed of the warp yarns while removing a biting-in condition of the weft yarn in the warp yarn shed under the cooperation of the suction-type weft traction device and the grasping-type weft traction device. Additionally, such a biting-in condition of the weft yarn in the warp yarn shed can be further promoted under vibration of the grasping-type weft traction device under grasping and drawing the mispicked weft yarn. This can suppress the suction force of the suction-type weft traction device at a relatively low value, preventing the suction force from excessively increasing. As a result, the mispicked weft yarn can be securely extracted from the array of the warp yarns without being broken at its intermediate part.

Figure 31:
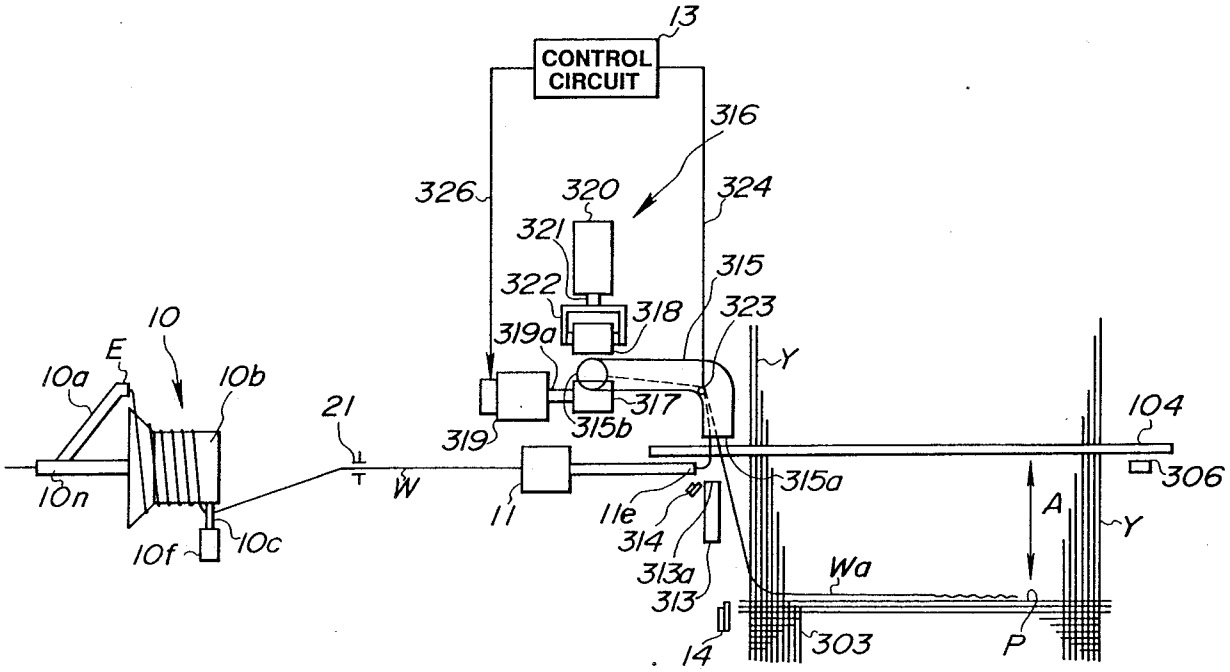
FIG. 31 is a schematic illustration of a sixth embodiment of the weft threading system incorporated with the loom, in accordance with the present invention.
Figure 32:
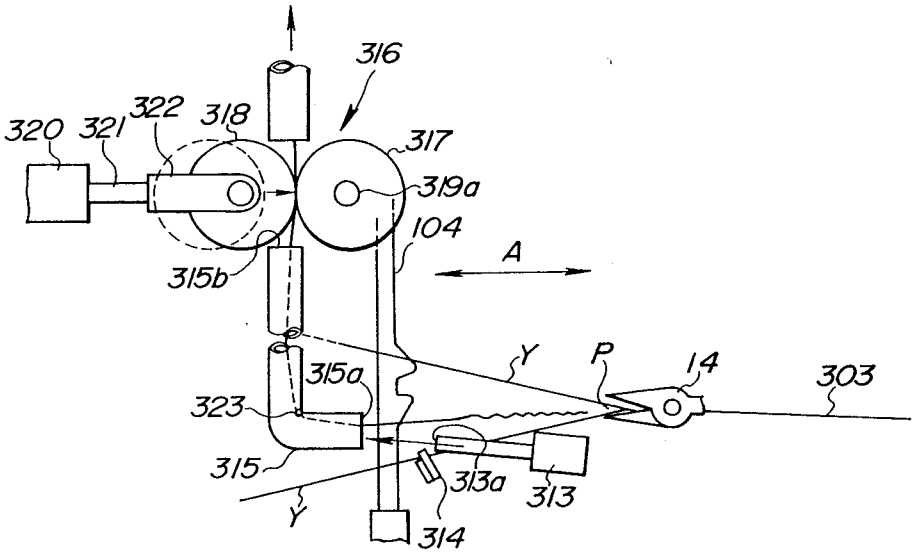
FIG. 32 is an enlarged fragmentary side view of an essential part of the loom of FIG. 31.
Figure 33:
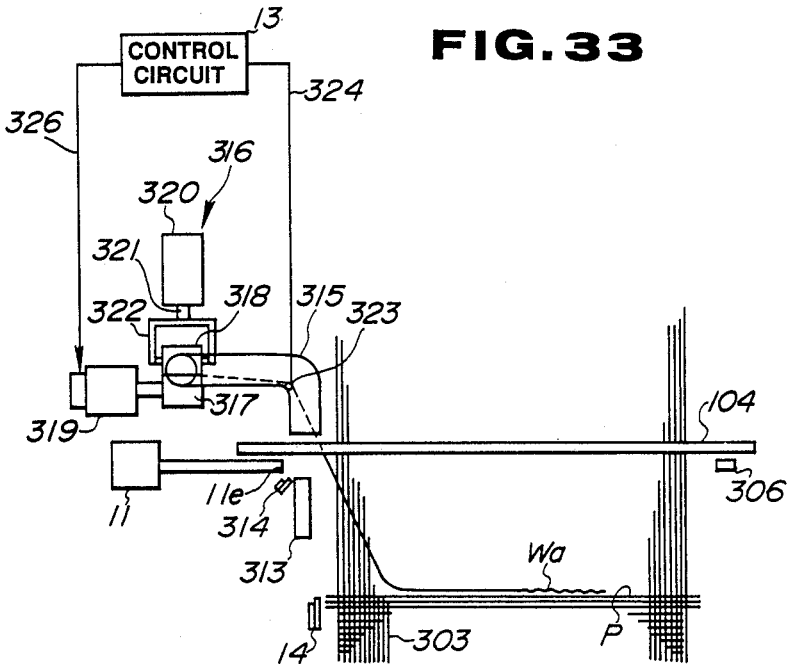
FIG. 33 is a schematic illustration similar to FIG. 31, showing an operational state of an essential part of the loom.

FIGS. 31 to 33 illustrate a sixth embodiment of the weft threading system of the present invention, which is similar to the first and second embodiments. This embodiment is incorporated with a shuttleless loom (fluid jet loom) which is provided with a faulty weft treatment system for the faulty or mispicked weft yarn. The shuttleless loom is equipped, as usual, with the reed 104 for beating up the picked weft yarn against the cloth fell P of the woven fabric 303. The weft inserting nozzle 11 is provided to project the weft yarn W into the shed of the warp yarns Y to reach the counter-weft picking side. The weft inserting nozzle 11 is arranged to be swingably movable together with the reed 104 as a one-piece member. Reaching of the weft yarn onto the counter-weft picking side is sensed by a feeler 306 disposed on the counter-weft picking side. The feeler 306 is arranged to sense the picked weft yarn W to generate a signal in response to which operation of a driving mechanism (not shown) of the loom is controlled in which weaving operation for the fabric 303 is controlled to be continued or stopped. The cutter 14 is provided to cut the picked weft yarn at a portion near the edge of the woven fabric 303 on the weft picking side. The weft storage unit 10 is arranged to store a predetermined length of the weft yarn W prior to weft picking. The weft storage unit 10 includes the drum **10*b* rotatably mounted on the rotatable drive shaft 10*n*. The weft winding arm 10*a* is fixedly secured to the drive shaft 10*n*. The measuring pawl or engagement pin 10*c* is controllably operated by the actuator 10*f* in such a manner as to insert into and withdraw from the drum 10*b*. The tip end section E of the weft winding arm 10*a* is rotatable together with the drive shaft 10*n*. Rotation of the weft winding arm 10*a* is controlled so that the predetermined length of the weft yarn is wound on the drum 10*b*. The weft guide 21 is disposed between the weft storage unit 10 and the weft inserting nozzle 11** in order to guide the moving weft yarn W.

An air ejection nozzle 313 forming part of the faulty weft treatment system is disposed near the tip end section **11*e* of the weft inserting nozzle 11 and on the side of the cloth fell P relative to the reed 104. A cutter 314 is disposed near the air ejection opening 313*a* of the nozzle 313. A generally L-shaped bent induction pipe 315 is disposed opposite to the nozzle 313 with respect to the weft inserting nozzle 11. More specifically, the open end 315*a* of the induction pipe 315 faces the air ejection opening 313*a* of the air ejection nozzle 313 in such a manner that the axis of the bent end section (having the open end 315*a*) of the induction pipe 315 is generally aligned with the axis of the air ejection nozzle 313. A pair of rollers 317, 318 forming part of a weft traction device 316 are disposed near the open end 315*b* of the main section of the induction pipe 315. The roller 317 is fixedly mounted on an output shaft 319*a* of a servomotor 319. The roller 318 is rotatably mounted on a shaft (no numeral) supported by a bifurcated arm 322 which is fixedly secured to a drive rod 321 forming part of an actuator 320. The rollers 317, 318 are usually separate from each other but contactable with each other when the drive rod 321 projects toward the roller 317 under the action of the actuator 320**.

A tension detector 323 is disposed inside the induction pipe 315 to detect a tensioned state of the weft yarn W supplied into the induction pipe 315. A signal line 324 is provided to electrically connect the tension detector 323 with the control circuit 13. The control circuit 13 is adapted to produce a signal in response to the signal from the tension detector 323 and output the signal to the servomotor 319 through a signal line 326.

With this arrangement, when the loom is normally operating, the measuring pawl **10*c* gets out of the drum 10*b* under driving action of the actuator 10*f* so that the predetermined length of the weft yarn W wound on the drum 10*b* is introduced through the weft guide 21 into the weft inserting nozzle 11. Then the weft yarn W is projected from the weft inserting nozzle 11 into the shed opening of the warp yarns Y at a predetermined timing thus accomplishing a weft picking. If such a weft picking is normally accomplished so that the weft yarn W reaches the counter-weft picking side of the woven fabric 303, the feeler 306 detects the presence of the weft yarn W, while the reed 104 advances to accomplish the beating-up operation of the reed 104. Then, the weft yarn W is cut by the cutter 14 disposed near the side edge of the woven fabric 303 on the side of the weft inserting nozzle 11**. Thereafter, weaving operation of the loom is continued.

If a so-called mispick occurs in which the picked weft yarn W does not reach the side edge of the woven fabric 303 on the counter-weft picking side, operation is made as follows: Since the picked weft yarn W does not reach and cannot be detected by the feeler 306, the loom is stopped after completion of about one revolution of the loom, more specifically completion of a loom revolution of about 300 degrees in rotational angle of the loom main shaft on the assumption that the beating-up operation of the reed 104 is made at 0 degree in the loom main shaft rotational angle. During the process of such loom stopping, operation of the cutter 14 and the weft storage unit 10 is stopped and the weft yarn projected from the weft inserting nozzle 11 into the warp shed is connected with the tip end section 11*e* of the weft inserting nozzle 11. After completion of loom stopping, the loom is reversely revolved automatically or manually to establish a condition in which the reed 104 is the farthest from the cloth fell P so that the mispicked weft yarn Wa is exposed at the cloth fell P. Thereafter, the measuring pawl 10*c* of the weft storage unit 10 is withdrawn from the drum for a predetermined time, simultaneously with air ejection from the air ejection nozzle 313. Then, the mispicked weft yarn Wa extending from the weft inserting nozzle tip end section 11*e* to the warp yarn shed is introduced into the induction pipe 315 through the open end 315*a* and reaches the other open end 315*b* of the induction pipe 315 maintaining its U-shaped bent state as shown in FIG. 31. At this time, the weft yarn Wa connected to the weft inserting nozzle tip end section 11*e* is cut by the cutter 314 while starting the actuator 320. As a result, the roller 318 is brought into press contact with the roller 317 so that the weft yarn Wa projected from the induction pipe open end 315*b* is grasped between the rollers 317, 318 as shown in FIGS. 32 and 33. The tension detector 323 detects the tension of the weft yarn Wa introduced in the induction pipe 315. In this connection, the tension detector 323 is located on the inner surface of the bent portion of the induction pipe 315 in such a manner that the weft yarn Wa connected from the warp yarn shed to the contacting rollers 17, 18 is passed on the tension detector 323 to detect the tension applied to the weft yarn W in such a condition. The tension detector 323 generates a signal representative of the tension of the weft yarn Wa and feed it to the control circuit 13 through the signal line 324. When the tension of the weft yarn Wa is not higher than a predetermined level, the control circuit 13 works to operate the servomotor 319 so that the roller 317 is driven to rotate through the output shaft 319*a*. Accordingly, the weft yarn Wa grasped between the rollers 317, 318 is drawn upwardly in FIG. 32 or in the direction that the mispicked weft yarn W in the warp shed moves from the counter-weft picking side to the weft picking side, thereby cancelling a biting-in condition of the mispicked weft yarn W into the array of the warp yarns Y. Thus, the picked weft yarn Wa is successively separated from the cloth fell P of the woven fabric 303 and passed through the inside of the induction pipe 315 to be drawn outside of the induction pipe 315.

Figure 34:
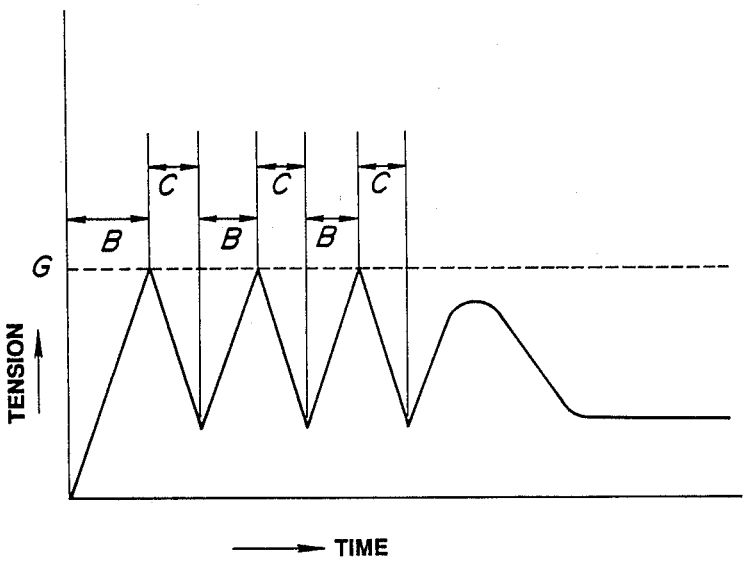
FIG. 34 is a graph showing the operation of the essential part of FIG. 33.

When the tension detector 323 detects the fact that the tension of the weft yarn Wa within the induction pipe 315 seems to exceed an allowable upper limit G (indicated in FIG. 34) during pulling of the weft yarn by the rollers 317, 318, the signal representative of this fact is fed to the control circuit 13. Then the control circuit 13 works to output an operation stopping signal to the servomotor 319, thereby stopping the operation of the servomotor 319. As a result, the pulling of the weft yarn Wa by the rollers 317, 318 is interrupted to temporarily lower the tension of the weft yarn Wa introduced in the induction pipe 315. When the tension of the weft yarn Wa has been lowered below a predetermined level, the tension detector 323 detects such a lowered tension to feed the signal representative of the lowered tension to control circuit 13, so that the control circuit 13 works to operate the servomotor 319 thereby to restart the pulling action of the rollers 317, 318. During such operation, the tension of the weft yarn Wa to be removed varies as shown in FIG. 34, in which pulling action of the traction device 316 is continued during a time period indicated by a range B until the tension of the weft yarn W reaches the predetermined level G while and is interrupted for a predetermined time as indicated by a range C after the tension reaches the predetermined level G. After the pulling action of the weft yarn Wa proceeds to such an extent that the weft yarn tension cannot reach the predetermined level G, only pulling action of the traction device 316 is continued to remove the mispicked weft yarn W out of the traction device 316. Thus, the mispicked weft yarn Wa can be gradually pulled out from the shed opening of the warp yarns Y to be removed without application of excessive tension thereby preventing breakage of the weft yarn to be removed.

While the tension detector 323 has been shown and described as being disposed inside the induction pipe 315, it will be understood that it may be disposed at other places where the tension of the weft yarn to be removed can be detected. Although the traction device 316 for the weft yarn W has been shown and described as being disposed on the side of the weft inserting nozzle 11 relative to the cloth fell P, it will be appreciated that it may be disposed on the opposite side of the weft inserting nozzle 11 relative to the cloth fell P or disposed over the central section of the woven fabric 303.

As appreciated from the above, according to the sixth embodiment, during pulling of the faulty weft yarn due to mispick from the shed of the warp yarns, the faulty weft yarn can be effectively prevented from its breakage at the initial stage in which pulling resistance is higher due to friction of the weft yarn to the warp yarns or the like. In other words, the pulling action for the faulty weft yarn can be accomplished within an allowable tension range for preventing breakage of the weft yarn, thus avoiding occurrence of a weft yarn breakage accident. This eliminates troublesome treatment steps for a broken weft yarn thus making possible continuation of smooth weaving operation of the loom.

Figure 35:
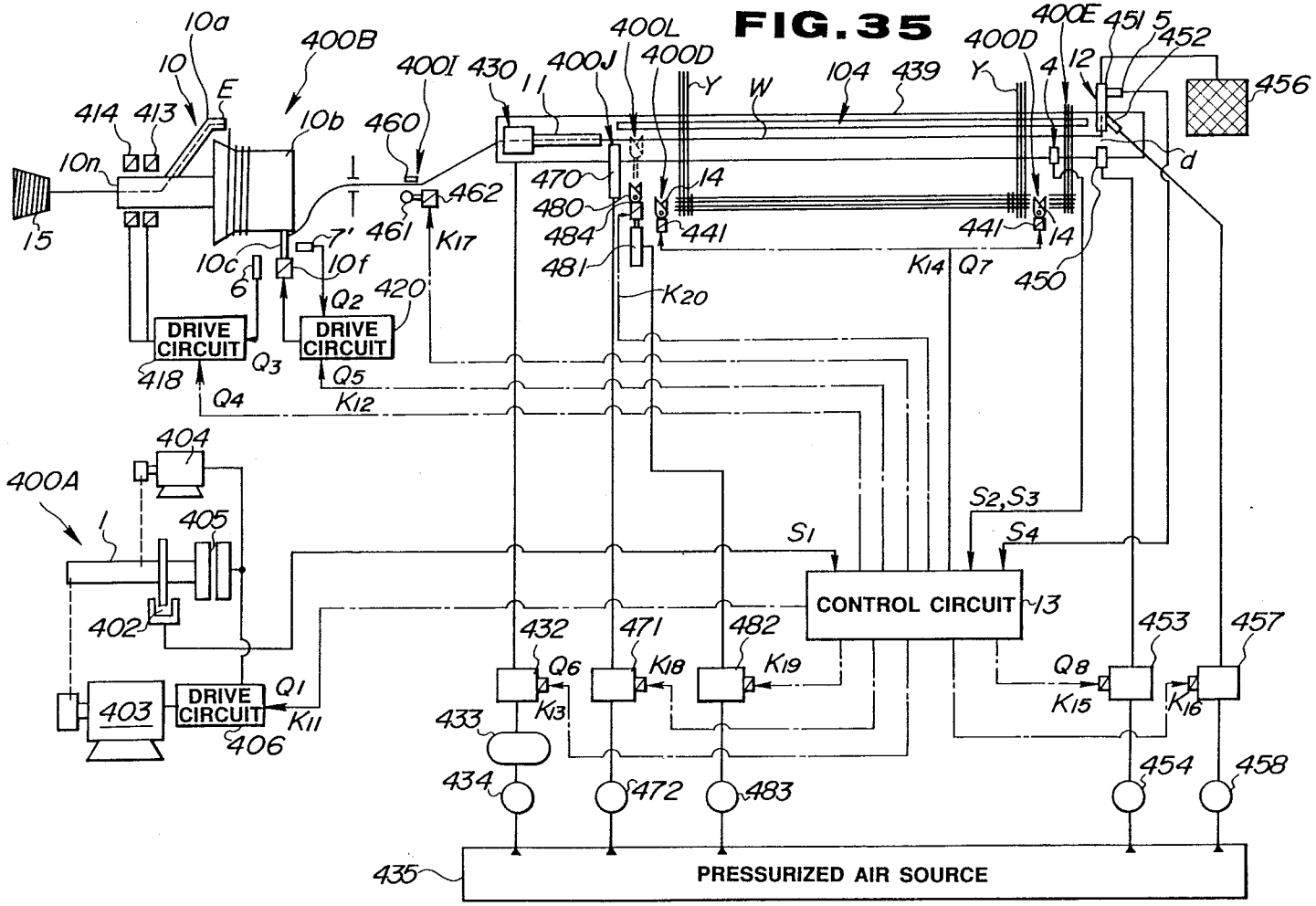
FIG. 35 is a schematic illustration of a seventh embodiment of the weft threading system incorporated with the loom, in accordance with the present invention.
Figure 36:
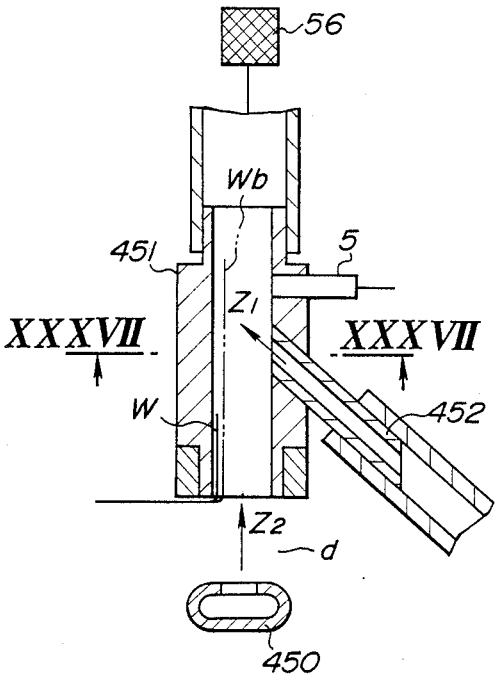
FIG. 36 is a fragmentary vertical sectional view of an essential part of the loom of FIG. 35.
Figure 37:
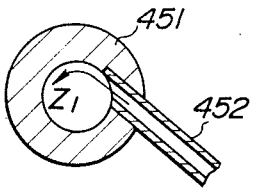
FIG. 37 is a cross-sectional view taken in the direction of arrows substantially along the line XXXVII—XXXVII of FIG. 36.

FIGS. 35 to 37 illustrate a seventh embodiment of the weft threading system of the present invention, which is similar to the first and second embodiments and is incorporated with a shuttleless loom (fluid jet loom). The loom comprises a driving system 400A which includes a main shaft, 401 by which a variety of moving parts of the loom are driven. An encoder 402 is provided to output a rotational angle signal S1 (representative of the rotational angle) of the main shaft 401 to the control circuit 13. The main shaft 401 is driven to normally rotate in response to a driving signal $Q_1$ output from the control circuit 13 during normal operation of the loom, while it is driven to reversely rotate by a submotor 404 and stopped at a predetermined rotational angle by an electro-magnetically operated self-reset type brake 405 in response to a treatment signal $K_{11}$ from the control circuit 13 when mispick or faulty picking has occurred. The main motor 403, the submotor 404 and the brake 405 are electrically connected with the control circuit 13 through a drive circuit 406 which is adapted to be switched ON and OFF in response to the driving signal $Q_1$ and the treatment signal $K_{11}$.

A weft picking system 400B includes the weft storage unit 10 and is arranged to store the weft yarn W which has a length corresponding one or more weft picking and drawn out from the weft supply member 15 in each weaving cycle of the loom. The weft yarn W from the weft storage unit 10 is introduced into the weft inserting (main nozzle) 11 to be picked under influence of the air jet ejected from the weft inserting nozzle 11. In this embodiment, the weft storage unit 10 includes the weft winding arm 10*a* fixedly secured to the drive shaft 10*n* which is driven by a motor 413. The weft winding arm 10*a* relatively rotates around the drum 10*b* to wind the weft yarn W on the stationary drum 10*b*. An electromagnetically operated self-reset type brake 414 is provided to brake the rotation of the drive shaft 10*n*. The measuring pawl or engagement member 10*c* is engageable with (insertable in) and disengageable (separable) from the front end section of the drum 10*b*. The unwinding sensor 7' detects the amount of the weft yarn W unwound from the drum 10*b* and is adapted to output a unwinding amount detection signal $Q_2$ when the weft yarn W has been unwound in a sufficient amount to be received by the counter-weft picked side weft traction device 12. The storage amount sensor 6 is to detect the storage amount of the weft yarn W wound on the drum 10*b* and is adapted to output a storage amount detection signal $Q_3$ when the weft yarn W is wound in an amount corresponding to one pick or more on the drum 10*b*. The motor 413 and the brake 414 are electrically connected with the control circuit 13 through a drive circuit 418 which is adapted to control operation of the motor 13 and the brake 14 in response to a driving signal $Q_4$ output from the control circuit 13 and the storage amount detection signal $Q_3$ output from the weft storage amount sensor 6. More specifically, in response to the driving signal $Q_4$, the brake 14 is released while the motor 13 is driven; and in response to the storage amount detection signal $Q_3$, the motor 14 is stopped while the brake 14 is operated or applied. The measuring pawl 10*c* is adapted to be engageable with and disengageable from the drum 10*b* under the action of the electromagnetically operated self-reset type actuator 10*f*. The actuator 10*f* is electrically connected with a drive circuit 420 which is adapted to be switched ON and switched OFF in response to a driving signal $Q_5$ and a treatment signal $K_{12}$ output from the control circuit 13, and in response to a unwinding amount detection signal $Q_2$ output from the weft unwinding sensor 7'.

The weft picking nozzle system 430 includes the weft inserting nozzle 11 which is swingingly movable in the fore-and-aft direction together with the reed 104. The weft inserting nozzle 11 is fluidly connected with a pressurized air source 435 through a directional control valve 432, a tank 433 and a pressure regulator 434. The directional control valve 432 is of the electromagnetically self-reset type and adapted to take its opened and closed positions respectively in response to a driving signal $Q_6$ and a treatment signal $K_{13}$ output from the control circuit 13.

Accordingly, the weft picking nozzle system 430 is arranged as follows: When the weft winding arm 10*a* is rotatingly driven by the motor 413 under a state in which the measuring pawl 10*c* engages with the drum 10*b*, the weft yarn W extended between the weft inserting nozzle 11 and the weft winding arm 10*a*is caught by the measuring pawl 10*c* while being drawn out from the weft supply member 15 thereby to be wound on the drum 10*b*. Then in response to the weft storage amount detection signal $Q_3$ from the weft storage amount sensor 6, the motor 413 is stopped while the brake 314 is operated to bring the weft winding arm 10*a* into the stationary state. Additionally, in response to the driving signal $Q_5$ from the control circuit 13, the measuring pawl $10_a$ is released or separated from the drum 10*b*. At this time, the weft yarn W is projected from the weft inserting nozzle 11 under the influence of the air jet ejected from the nozzle 11 and flies toward the counter-weft picking side weft traction device 12 through the shed opening of the warp yarns Y forward of the reed 104 and a counter-weft picking side weft catching device 400E thereby to accomplish a weft picking. In response to the unwinding amount detection signal $Q_2$ from the weft unwinding amount detector 7', the measuring pawl 10*c* is engaged with the drum 10*b* so that the weft yarn W is caught by the measuring pawl 10*c* thereby completing the weft picking of one pick.

The reed 104 is fixedly secured to a reed holder 439 and is arranged to be swingingly movable in the direction of extension of the warp yarns Y under the action of a beating-up system (not shown) driven in timed relation to the loom main shaft 401. A usually used cutter system 400D functions to cut the weft yarn W upon being beaten up thereby to set the picked weft yarn W to have a predetermined length after the reed 104 has been moved backward and the upper and lower arrays of the warp yarns Y are replaced with each other. The usually used cutter system 400D includes the weft picking side cutter 14 and the counter-weft picking side cutter 14 which are located on the opposite sides of the woven fabric and by the cloth fell P. Each cutter 14 is operated by an electromagnetically operated self-reset type actuator 441 electrically connected with the control circuit 13. The actuator 441 is adapted to cause the cutter 14 to and to be restored to its original state in response to a driving signal $Q_7$ output from the control circuit 13, while to cause the cutter 14 to be brought into an inoperative position in response to a treatment signal $K_{14}$ output from the control circuit 13.

The counter-weft picking side weft catching device 400E includes catch cords which are located on the counter-weft picking side and are separate from each other by a predetermined distance and arranged to make their shedding-operation thereby to catch the leading end section of the picked weft yarn W between the upper and lower catch cords. The shedding-operation of the catch cords are made in timed relation to the shedding-operation of the warp yarns Y.

The counter-weft picking side weft traction device 12 includes an air ejection nozzle 450 which is located on the counter weft picking side relative to the weft catching device 400E and arranged to be swingingly movable together with the reed 104 as a one-piece member. The weft traction device 12 further includes an air induction pipe 451 which is located opposite to or facing the nozzle 450 and swingingly movable together with the nozzle 450 as a one-piece member. A vortex generating nozzle 452 is provided to the central section of the air induction pipe 451. The tip end of the air induction pipe 451 is separate from that of the nozzle 450 to form a clearance d therebetween in such a manner that the leading end section of the flying weft yarn W projected from the weft inserting nozzle 11 is inserted into the clearance d. The nozzle 450 is fluidly connected with the pressurized air source 435 through a directional control valve 53 and a pressure regulator 454. The directional control valve 453 is of the electromagnetically operated self-reset type and is adapted to take its closed valve position and its open valve position respectively in response to a treatment signal $K_{15}$ and a driving signal $Q_8$ output from the control circuit 13. A yarn trapping device 456 is connected to the air induction pipe 451.

As shown in detail in FIGS. 36 and 37, the vortex generating nozzle 452 is attached to the air induction pipe 451 to communicate with each other in such a manner that the axis of the nozzle 452 inclines to the axis of the air induction pipe 451. In this connection, the tip end section (attached to the pipe 451) of the vortex generating nozzle 452 is positioned on upstream side relative to the other end section of the same in the direction of flow of air stream $Z_2$ inside the air induction pipe 451 as clearly shown in FIG. 36. Additionally, the vortex generating nozzle 452 is arranged to eject the air stream $Z_1$ tangentially relative to the inner peripheral surface of the air induction pipe 451 as clearly shown in FIG. 37. This vortex generating nozzle 452 is fluidly connected with the pressurized air source 435 through a directional control valve 457 and a pressure regulator 458. The directional control valve 457 is of the electromagnetically operated self-reset type and is adapted to be brought from its closed valve position into its opened valve position in response to a treatment signal $K_{16}$ output from the control circuit 13. Accordingly, the counter-weft picking side weft traction device 12 operates as follows: During normal loom operation, in response to the driving signal $Q_8$, pressurized air is ejected from the nozzle 450 and blows from the side direction the leading end section of the flying weft yarn W projected from the weft inserting nozzle 11 and reaching the clearance d between the nozzle 450 and the air induction pipe 451, so that the leading end section of the thus flying weft yarn W is forced into the air induction pipe 451 to be caught by the peripheral edge of the pipe 451. When a mispick occurs, in response to the treatment signals $K_{15}$, $K_{16}$, the mispicked weft yarn Wa and the broken weft yarn Wb are fed into the yarn trapping device 456 under the influence of the air jet from both the air ejection nozzle 450 and the vortex generating nozzle 452 or under the influence of one of them. As shown in FIG. 36, the weft breakage sensor 5 is fixedly secured to the air induction pipe 451 and is located on the upstream side of the vortex generating nozzle 152 in the direction of air flow within the air induction pipe 451 in order to detect the broken weft yarn Wb (indicated in phantom) present inside the air induction pipe 451. In this connection, during the normal loom operation, the leading end section of the weft yarn W is located on the upstream side of the breakage sensor 5 in the direction of air stream flow within the air induction pipe 451 as indicated by solid line in FIG. 36 so that the leading end section of the weft yarn W cannot be detected by the breakage sensor 5.

The weft sensor 4 is located between the edge of the array of the warp yarns Y and the counter-weft picking side weft catching device 400E and is arranged to be swingingly movable together with the reed 104 as a one-piece member. The weft sensor 4 is adapted to detect the presence of the weft yarn W to output a weft presence signal $S_2$ and to detect the absence of the same to output a weft absence signal $S_3$. The signals $S_2$, $S_3$ are fed to the control circuit 13. The weft breakage sensor 5 is adapted to output a weft breakage detection signal $S_4$ representative of presence of the broken weft yarn Wb which has reached a position detectable by the weft breakage sensor 5 as indicated by the dash-dot-dot line in FIG. 36. It will be understood that the weft yarn W cannot reach the position during normal loom operation. The breakage detection signal $S_4$ is fed to the control circuit 13.

A weft brake device 400I is disposed between the weft storage unit 10 and the weft inserting nozzle 11 and is arranged to selectively take its weakly grasping condition and its releasing condition. In the weakly grasping condition, the weft yarn W is weakly grasped so as to be possible to be drawn out from the drum **10*b*. In the releasing condition, the weft yarn W is released from its restraint to be allowed to be drawn out from the drum 10*b*. The weft brake device 400I includes a stationary member 460 having a soft grasping surface section (not identified) formed of rubber or soft plastic. A movable member 461 is provided facing the stationary member 460 and is arranged contactable with and separatable from the stationary member 460 under the action of an actuator 462. The weft brake device 400I is brought into its weakly grasping condition when the movable member 461 contacts with the stationary member 60 while into its releasing condition when the movable member 461 separates from the stationary member 460. The actuator 462 is of the electromagnetically operated self-reset type and is adapted to cause the movable member 461 to separate from the stationary member 461 in response to a treatment signal $K_{17}$ output from o the control circuit 13**.

A weft entangling preventive device 400J is provided to prevent the mispicked weft yarn Wa connected to the weft inserting nozzle 11 from being entangled with the warp yarns Y when the mispick occurs. The weft entangling preventive device 400J includes an air blowing pipe 470 disposed between the weft inserting nozzle 11 and the weft picking side weft cutter 14. The air blowing pipe 470 is fluidly connected with the pressurized air source 435 through a directional control valve 471 and a pressure regulator 472, and is arranged to eject the air stream onto the mispicked weft yarn Wa near the weft inserting nozzle 11 from the side direction of the weft yarn Wa when the directional control valve 471 is brought into its opened valve position. The directional control valve 471 is of the electromagnetically controlled self-reset type and is adapted to be brought from its closed valve position into its opened valve position in response to a treatment signal $K_{18}$ output from the control circuit 13.

A treatment cutter device 400L is arranged to cut the weft yarn W connected to the weft inserting nozzle 11 prior to a restart of operation of the loom after the mispicked weft yarn Wa, Wb is suitably treated or removed. The treatment cutter device 400L includes a cutter 480 disposed between the air blowing pipe 470 of the weft entangling preventive device 400J and the cutter 14 of the usually used cutter device 400D. The cutter 480 is operatively connected to an actuator 484 attached to an end section of the operating or piston rod of a pneumatically operated cylinder 481 so as to be movable between its withdrawal position indicated by solid line and its cutting position indicated in phantom in FIG. 35 under extension and contraction operation of the cylinder 470. The cylinder 481 is fluidly connected with the pressurized air source 435 through a directional control valve 482 and a pressure regulator 483. The directional control valve 482 is of the electromagnetically operated self-reset type and is brought from its closed valve position to restrict the extension and contaction operation of the cylinder 481 into its extending position in response to a treatment signal $K_{19}$ output from the control circuit 13. When the direction control valve 482 is in the extending position, it is brought from its extending position into its contacting position upon lapse of a time required for a cutting action of the cutter 480, and thereafter is brought from the contracting position to its closed valve position. In the above-mentioned extending position, the cylinder 481 extends so that the cutter 480 moves to the cutting position to make its cutting action for the weft yarn. In the above-mentioned contracting position, the cylinder 481 contracts so that the cutter 480 moves to the withdrawal position. The cutter 480 is driven or operated to make its cutting action by the actuator 484. This actuator 484 is of the electromagnetically operated self-reset type and is adapted to make its cutting action and then to restore the cutter 480 to its original or open state in response to a treatment signal $K_{20}$ output from the control circuit 13.

The control circuit 13 is adapted to accomplish preparation for weaving operation of the loom in accordance with the driving signals $Q_1$, $Q_4$ to $Q_8$, the weft unwinding amount detection signal $Q_2$ and the weft storage amount signal $Q_3$ under switching operation of an operation preparation switch (not shown) and a starting switch (not shown), and to control the weaving operation of the loom in accordance with a preset program. Additionally, the control circuit 13 works to controllably accomplish a weft treatment discussed after, in response to the weft absence detection signal $S_3$ from the weft sensor 4 and the weft breakage detection signal $S_4$ from the weft breakage sensor 5 and in accordance with a preset program for a weft picking period during normal loom operation.

The manner of operation of the thus configurated seventh embodiment will be discussed with reference to FIGS. 38A to 41B.

In the event that the weft yarn W which is projected from the weft inserting nozzle 11 and flying under the influence of air jet stream ejected from the nozzle 11 is broken or cut within the shed opening of the warp yarns Y as shown in FIG. 38A, it is assumed that the weft yarn W is divided into the mispicked weft yarn Wa connected to the weft inserting nozzle 11 and the broken weft yarn Wb on the counter-weft picking side so that the broken weft yarn Wb is taken into the air induction pipe 451 deeply under the influence of air jet ejected from the air ejection nozzle 50 as indicated in phantom in FIG. 36 and by solid line in FIG. 38A, different from normal loom operation. As a result, the weft breakage sensor 5 detects the presence of the broken weft yarn Wb thereby to output the weft breakage detection signal to the control circuit 13.

Then, the control circuit 13 outputs the treatment signals $K_{11}$, $K_{12}$, $K_{19}$, $K_{17}$ and $K_{18}$ respectively to the driving system 400A, the weft picking system 400B, the usually used cutter device 400D, the weft brake device 400I and the weft entangling preventive device 400J. More specifically:

(1-a) The cutters 14 of the usually used cuter device 400D is made inoperative in response to the treatment signal $K_{14}$ to stop its cutting action thus stopping the cutting function of the loom.

(1-b) The main motor 403 is allowed to inertially rotate while operating the brake 405 in response to the treatment signal $K_{11}$ thereby to stop the main shaft 401 at the next weaving cycle relative to the weaving cycle in which the breakage of the picked weft yarn W has occurred. Then, the mispicked weft yarn Wa and the broken weft yarn Wb are brought into their conditions as indicated by solid lines in FIGS. 38A and 38B. At this time, the length of path of the weft yarn W increases under the engagement of the measuring pawl **10*c* with the drum 10*b*, the inoperation condition of the cutters 14 and the swinging movement of the weft inserting nozzle 11. Even in this condition, the weft yarn W including the mispicked weft yarn Wa is prevented from its breakage because the measuring pawl 10*c* is separated or disengaged from the drum 10*b* for a predetermined time in response to the treatment signal K so that the weft yarn having a length corresponding to one turn is unwound from the drum 10*b*. Additionally, the weft brake device 400I weakly grasps the weft yarn W in response to the treatment signal $K_{17}$ so that the weft yarn W unwound from the drum 10*b* is drawn passing through between the movable member 460 and the stationary member 461** in a manner to prevent the weft yarn W from being unnecessarily prolonged.

Subsequently, in response to the above treatment signal $K_{11}$, the brake 405 is released while operating the submotor 404 to rotate thereby causing the submotor 404 to reversely rotate. Then, the submotor 404 is allowed to inertially rotate at the weaving cycle in which the breakage of the weft yarn W occurs, while the brake 405 is operated or applied to cause the main shaft 401 to stop at a rotational position at which the reed 104 is put into its most rearward position while the shed opening of the warp yarns Y becomes the maximum. As a result, the upper warp yarn array Ya and the lower warp yarn array Yb are alternately replaced with each other as shown in FIG. 39B, so that the mispicked weft yarn Wa and the broken weft yarn Wb are exposed at the cloth fell P. At this time, the length of the weft path is decreased so that the weft yarn W is slightly slackened upon the swinging movement of the reed 104; however, pressurized air is ejected from the air blowing pipe 470 in response to the treatment signal $K_{18}$ to blow the mispicked weft yarn Wa as shown in FIG. 39A, thus preventing the slackened weft yarn W from entering the warp shed and from being woven in the fabric.

Next, the control circuit 13 works to controllably operate the weft picking system 400B, the counter-weft picking side weft traction device 12, the weft entangling preventive device 400J, the weft brake 400I and the treatment cutter device 400L in response to the treatment signals $K_{12}$, $K_{13}$, $K_{15}$ to $K_{20}$, thereby removing the mispicked weft yarn Wa and the broken weft yarn Wb. More specifically:

(b-1) In response to stopage of the treatment signal $K_{17}$, the weft yarn W is released from being weakly grasped by the weft brake 400I.

(b-2) In response to stopage of the treatment signal $K_{18}$, blowing the mispicked weft yarn Wa by the weft entangling preventive device 400J is stopped.

(b-3) In response to the treatment signal $K_{13}$, the weft inserting nozzle 11 ejects the air jet. Additionally in response to the treatment signals $K_{15}$ and $K_{16}$, pressurized air is ejected from the air ejection nozzle 450 and from the vortex generating nozzle 452.

(b-4) In response to the treatment signal $K_{12}$, the measuring pawl 10c is disengaged or separated from the drum 10b for a sufficient time required for reaching of the weft yarn W including the mispicked section Wa to the counter-weft picking side weft traction device 12. Accordingly, the mispicked weft yarn Wa and the broken weft yarn Wb fly toward the counter-weft picking side under the influence of the air jet ejected from the weft inserting nozzle 11, so that the leading end of the mispicked weft yarn Wa and the broken weft yarn Wb are forced into the air induction pipe 451 under the influence of air jet ejected from the air ejection nozzle 450. The thus forced mispicked weft yarn leading end Wa and the broken weft yarn Wb are entangled with each other under the action of vortex of air stream generated by the vortex generating pipe 452 and fed into the yarn trapping device 456. In this process, the mispicked weft yarn Wa and the broken weft yarn Wb are successively and gradually peeled off from the cloth fell P to be sucked into the counter-weft picking side weft traction device 12.

(b-5) Upon lapse of the required time for the above-mentioned process (b-4), the measuring pawl 10c is engaged with the drum 10b so that the weft yarn W drawn out from the drum 10b is caught by the measuring pawl 10c. As a result, the weft yarn W is extended from the weft inserting nozzle 11 to the counter-weft picking side weft traction device 12 through the shed opening of the warp yarns Y in front of the reed 104.

(b-6) In response to the treatment signals $K_{19}$ and $K_{20}$, the cutter 480 makes its cutting action when the treatment cutter device 400L moves to its yarn cutting position as shown in FIG. 41A. Thereafter, the loom is restarted under control of the control circuit 13 to accomplish normal loom operation.

In the event of mispick in which the leading end of the flying weft yarn W does not reach the counter-weft picking side, the mispick can be detected by outputting the weft absence detection signal $S_2$ from the weft sensor 4 to the control circuit 13. Also in this case, the mispicked weft yarn can be treated or removed in the same procedures as in the above-discussed treatment processes (a-1), (a-2) and (b-1) to (b-6).

Figure 42:
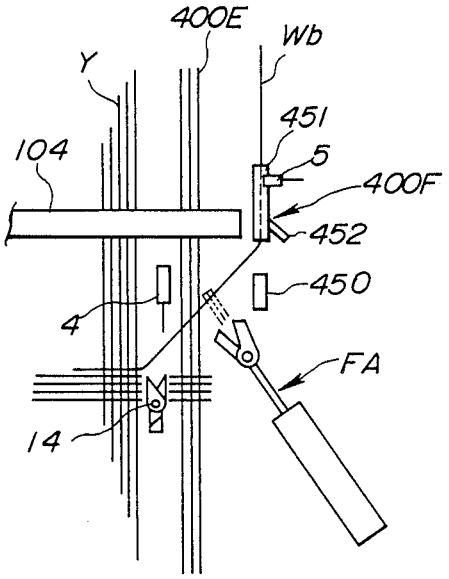
FIG. 42 is a fragmentary schematic illustration showing a modified example of the loom of FIG. 35.

While the counter-weft picking side weft traction device 12 has been shown and described as being of the suction type, it will be understood that it may be replaced with other devices such as one using a pair of rollers in which the weft yarn is pulled upon being inserted between the rollers or another one using a rod like member in which the weft yarn is pulled upon being rolled up thereon. Otherwise, as shown in FIG. 42, a grasping and pulling device FA may be additionally provided to grasp the broken weft yarn Wb and to compulsorily pull the weft yarn Wb from the side of the array of the warp yarns Y. In this case, even if a only short section of the broken weft yarn Wb is subjected to the pressurized air in the counter-weft picking side weft traction device 12, the broken weft yarn Wb can be securely pulled into the weft traction device 12 to be removed.

Thus, according to the seventh embodiment, not only the mispicked weft yarn connected to the weft inserting nozzle but also the broken weft yarn on the counter-weft picking side can be effectively automatically removed, thereby preventing the broken weft yarn from being woven into the fabric.

Figure 43:
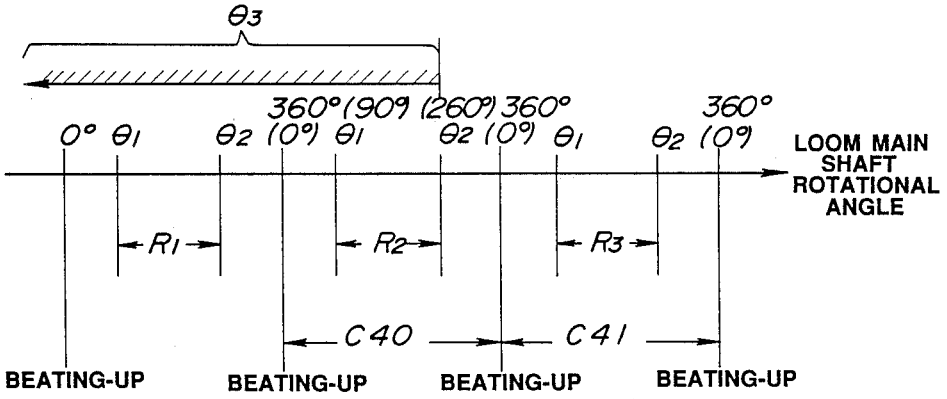
FIG. 43 is a graph showing the operation of a loom equipped with an eighth embodiment of the weft threading system according to the present invention.
Figure 44:
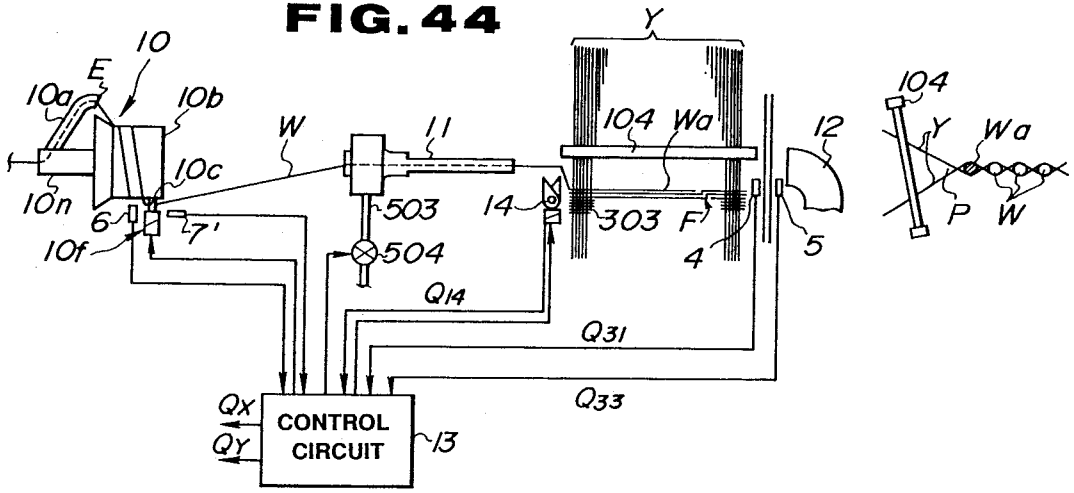
FIGS. 44 to 47 are schematic illustrations showing an operation of the loom of FIG. 43.
Figure 45:
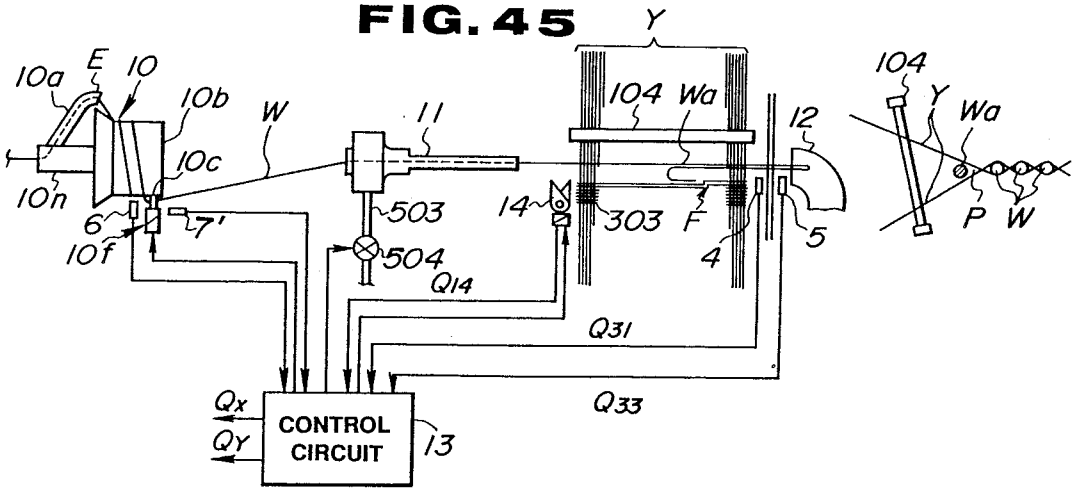
Figure 46:
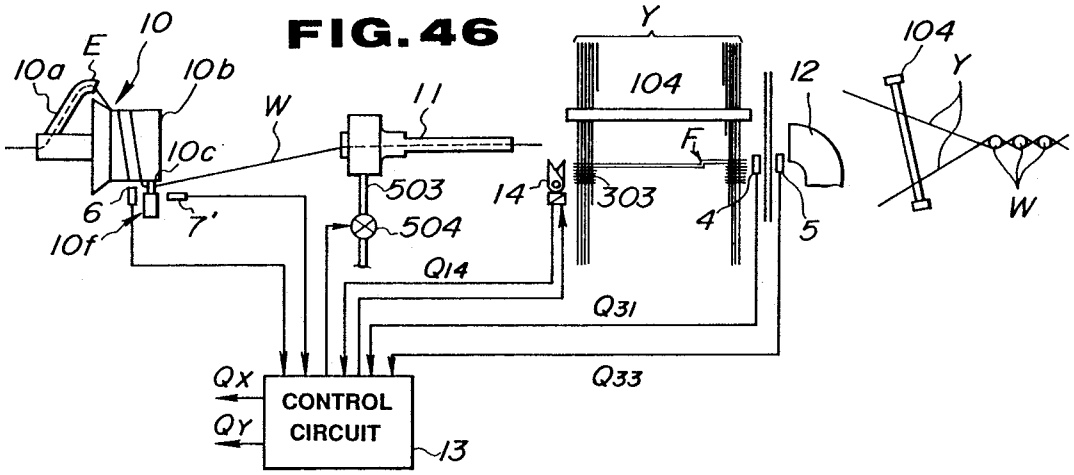

FIGS. 43 to 47 illustrate an eighth embodiment of the weft threading system of the present invention, which is similar to the first and second embodiment and is incorporated with a shuttleless loom (fluid jet loom). The operation of the loom is summarized as follows: When a mispick occurs (for example, the leading end section of the weft yarn W has not reached the counter-weft picking side, or the weft yarn W is broken or cut) during weaving operation of the loom, the control circuit 13 works to stop cutting action of the usually used cutter 14 for cutting the weft yarn W to have a predetermined length, i.e., stop the cutting function of the loom as shown in FIG. 44. Additionally, a directional control valve 504 fluidly connected through a fluid passage 503 is brought into its closed valve position under the action of the control circuit 13, thereby stopping fluid ejection from the weft inserting nozzle 11. Thereafter, the normal rotation of the loom main shaft (not shown) is stopped thereby stopping the weaving operation of the loom as shown in FIG. 44. In this process, the normal rotation of the loom main shaft 11 is stopped at the next weaving cycle C41 relative to the weaving cycle C40 in which the mispick occurs as shown in FIG. 43, since the loom main shaft rotates at a high speed. Upon lapse of a time from the detection of the mispick to the complete stopping of the loom main shaft, the control circuit 13 works to reversely rotate the loom main shaft at a speed lower than the normal rotation. The reverse rotation of the loom main shaft is stopped in the weaving cycle C40 in which the mispick has occurred. Then, upon the reverse rotation of the loom main shaft, the measuring pawl 10c of the weft storage unit 10 is inserted into the drum 10b in response to a command from the control circuit 13 while the reed 104 moves backward. At the same time, the upper and lower arrays of the warp yarns Y are replaced with each other, so that the faulty weft yarn Wa is exposed at the cloth fell P as shown in FIG. 45. Subsequently, the control circuit 13 works to selectively operate the suction type weft traction device 12 disposed on the counter-weft picking side relative to the weft sensor 4 for sensing normal weft picking, the directional control valve 504, the weft storage unit 10 and the usually used cutter 14, thereby to remove the faulty weft yarn Wa as shown in FIGS. 45 and 46.

The control circuit 13 works in addition to the above, to cause the reed 104 to make a so-called empty beating-up operation (bearing-up operation in a state without a picked weft yarn) from a main shaft rotational angle $\theta_3$ before completion of weft picking in the weaving cycle C40 before the weaving cycle C41 in which the weaving operation has been stopped after removal of the faulty weft yarn Wa, thereby restarting the loom operation. More specifically, the control circuit 13 functions to stop the reverse rotation of the loom main shaft so that the reed 104 stops at the main shaft rotational angle $\theta_3$ before a main shaft rotational angle $\theta_2$ at which the weft picking is completed in the weaving cycle C40 before the weaving cycle C41 in which the weaving operation is stopped, in the process of stopping the reverse rotation of the loom main shaft. Additionally, the control circuit 13 functions to output a signal $Q_x$ to a motor driving section (not shown) thereby to cause the loom main shaft to be rotatingly driven from the rotational angle $\theta_3$ when simultaneously supplied with a cutting action completion signal $Q_{14}$ representative of completion of cutting action of the usually used cutter 14, a weft absence detection signal $Q_{31}$ (from the weft sensor 4) representative of absence of the weft yarn, and a weft absence detection signal $Q_{33}$ (from the weft breakage sensor 5 disposed on the upstream side of the weft traction device 12) representative of absence of the weft yarn. In this embodiment, the beating-up position at which the reed 104 most approaches the cloth fell P is set at a main shaft rotational angle of 360°; the weft picking initiates at a main shaft rotational angle ($\theta_1$) of 90°; and the weft picking terminates at a main shaft rotational angle ($\theta_2$) of 260°. As a result, the above-mentioned empty beating-up operation is started at the loom rotational angle ($\theta_3$) before 260°. In FIG. 43, the reference characters $R_1$, $R_2$ can be made.

With this arrangement of the eighth embodiment, when the mispick occurs during the weaving operation, the weaving operation of the loom is first stopped. Thereafter, the loom is reversely revolved and stopped (as shown in FIG. 44) to remove the faulty weft yarn Wa by a manner suitable for a cause of the mispick. In this faulty weft yarn removal process, the control circuit 13 works to bring the directional control valve 504 into its opened valve position to eject the fluid jet from the weft inserting nozzle 11, to cause the measuring pawl 10*c* to get out from the drum 10*b* and to operate the suction type weft traction device 12 under the condition in which the faulty weft yarn Wa is exposed at the cloth fell P upon the above-mentioned reverse revolution and stopping of the loom. As a result, the faulty weft yarn Wa flies toward the counter-weft picking side under the influence of the fluid jet from the weft inserting nozzle 11 and reaches the weft traction device 12 to be taken in as shown in FIG. 45. Then, upon lapse of a time in which the faulty weft yarn W including the faulty weft yarn Wa is removed from the array of the warp yarns Y, the control circuit 13 works to cause the measuring pawl 10*c* to be inserted into the drum 10*b* and to cause the usually used cutter 14 to make its cutting action to cut a portion of the weft yarn W projected from the weft inserting nozzle 11 toward the side of the wary yarns Y. This brings the loom into a condition in which loom restarting is possible.

Subsequently, a weaving operation of the loom will be restarted. In this restarting process, in response to combination of the cutting action completion signal $Q_{14}$ for the usually used cutter 14, the weft yarn absence signal $Q_{31}$ from the weft sensor 4 and the weft yarn absence detection signal $Q_{33}$ from the weft breakage sensor 5, the control circuit 13 works to output the signal $Q_x$ to accomplish the following operations: The measuring pawl 10*c* is inserted into the drum 10*b* until a plurality of weaving cycles have been completed. The directional control valve 504 is brought into its closed valve position to stop fluid jet ejection from the weft inserting nozzle 11. The suction operation of the counter-weft picking side weft traction device 12 is stopped and the motor driving section for the loom main shaft is driven to rotate the loom main shaft normally or in a normal direction as during normal weaving operation of the loom. As a result, the reed 104 is struck against the cloth fell P during a plurality of weaving cycles in a state in which no weft picking is carried out, thereby accomplishing a plurality of the empty bearing-up operations.

Figure 47:
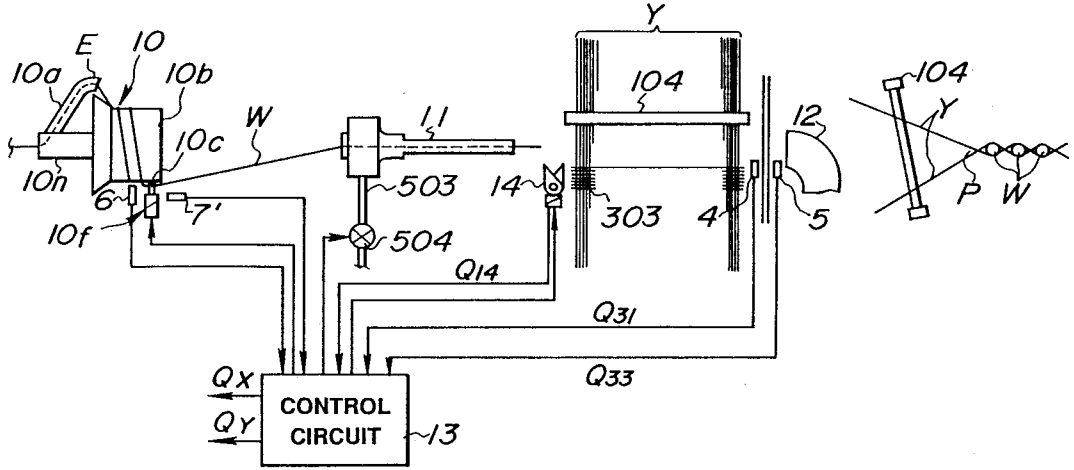

In the process of these empty beating-up operations, the rotational amount of the loom main shaft increases from the time of the restarting to the time of the first empty beating-up operation. In accordance with this increase, the rotational speed of the loom main shaft rises thereby raising beating-up force of the reed. Accordingly, during the plurality of the empty beating-up operations, the reed blades (not shown) of the reed 104 are strongly struck against the cloth gell P thereby straightening or correcting a weaving defect F formed in the several picked weft yarns W on the side of a woven fabric 500S from the cloth fell P as shown in FIGS. 44, 45 and 46. As a result, the picked weft yarns W forming the weaving defect F is brought into the straightened state as shown in FIG. 47. Experiments have revealed that the weaving defect F can be completely corrected by two or three times of the empty beating-up operations regardless of kinds of yarns.

Upon lapse of a time required to complete these two or three times of the empty beating-up operations, the control circuit 13 works to output a weaving control signal $Q_y$ in place of the signal $Q_x$ thereby selectively operating the weft storage unit 10, the directional control valve 504, a driving device (not shown) for the reed 104, a shedding mechanism (not shown) and the like at predetermined timings, thus successively weaving the fabric 500S.

Although only one control manner of this embodiment has been shown and described, it will be understood that the operation of this embodiment may be accomplished as follows: During the reverse revolution and stopping of the loom, the reed 104 is stopped at a loom main shaft rotational angle of 300° after the loom main shaft rotational angle $\theta_2$ at which the weft picking is completed in the weaving cycle C40 before the weaving cycle C41 in which the loom weaving operation is stopped. After removing the faulty weft yarn Wa, in response to the signal $Q_x$, the loom is reversely revolved to the loom main shaft rotational angle $\theta_3$ which is before 260° as the loom main shaft rotational angle $\theta_2$ at which the weft picking is completed in the weaving cycle C40 before the weaving cycle C41 in which the loom weaving operation is stopped. From this state, the loom is normally revolved thereby to accomplish empty beating-up operations of the reed 104.

Thus, according to this embodiment, the rotational amount of the loom main shaft is increased in a time period from the restarting of the loom to the first empty beating-up operation. Therefore, the beating-up force of the reed rises by an amount corresponding to the increased main shaft rotational amount, thereby correcting the weaving defect caused by mispick by a few times of empty beating-up operations regardless of the kind of yarn.

What is claimed is:

1. A weft threading system for a fluid jet loom having a weft storage unit, comprising:

a weft winding arm forming part of said weft storage unit, arranged to wind a weft yarn in an amount over a level corresponding to one pick on a drum under relative rotation of said weft winding arm and said drum;

means for ejecting a fluid jet from a tip end section of said weft winding arm to carry said weft yarn far from said tip end section;

a downstream side device disposed on a downstream side of said weft storage unit in a direction of movement of said weft yarn, said downstream side device being arranged to receive said weft yarn from said weft winding arm so that said weft yarn is threaded thereinto; and means for directing said fluid jet from said tip end section of said weft winding arm toward a weft inlet of said downstream side device.

2. A weft threading system as claimed in claim 1, wherein said downstream side device is a weft guide through which said weft yarn passes, said weft guide including means for ejecting a fluid jet to generate suction in said weft inlet and to carry said weft yarn toward a predetermined position.

3. A weft threading system as claimed in claim 1, wherein said downstream side device is a weft inserting nozzle including means for ejecting fluid to pick said weft yarn into a shed of warp yarns, and means for generating suction at said weft inlet of said weft inserting nozzle to suck said weft yarn from said weft winding arm.

4. A weft threading system as claimed in claim 1, wherein said fluid jet ejecting means includes means defining a weft passage in said weft winding arm, said weft yarn passing through said weft passage, said weft passage being formed along an axis of said weft winding arm, and nozzle means for ejecting the fluid jet, which passes through said weft passage to be ejected from said tip end section of said weft winding arm, to carry said weft yarn.

5. A weft threading device as claimed in claim 4, wherein an axis of said tip end section of said weft winding arm is directed to said weft inlet of said downstream side device.

6. A weft threading system as claimed in claim 4, further comprising means for rotating said weft winding arm so that said tip end section is rotatable around said drum, said rotating means including a drive shaft connected to said weft winding arm so that said weft winding arm is rotatable around an axis of said drive shaft, said drive shaft having along its axis a weft passage communicating with said weft passage of said weft winding arm so that said weft yarn, together with an air jet, is passed through said weft passage of said drive shaft and through said weft winding arm, wherein said nozzle means is arranged to eject the fluid jet into said weft passage of said drive shaft to force said weft yarn into said weft passages of said drive shaft and said weft winding arm.

7. A weft threading system as claimed in claim 6, wherein said nozzle means includes a fluid ejection nozzle having a nozzle opening whose axis is aligned with said axis of said weft passage of said drive shaft.

8. A weft threading system as claimed in claim 6, wherein said nozzle means includes a generally cylindrical nozzle body having a tapered first nozzle opening and a cylindrical second nozzle opening connected to said first nozzle opening, an axis of said second nozzle opening being aligned with said weft passage of said drive shaft; and a generally cylindrical needle having a tapered section which is disposed in said first nozzle opening of said nozzle body to define an annular air ejection opening between a tapered outer surface of said needle tapered section and a tapered inner surface of said nozzle body, said air ejection opening being communicable with a pressurized air source, said needle being formed with a weft introduction opening and communicating with said nozzle body first nozzle opening, said weft yarn being passed through said weft introduction opening and through said first and second nozzle openings.

9. A weft threading system as claimed in claim 1, wherein said downstream side device includes a weft guide disposed between said weft storage unit and said weft inserting nozzle and separate from said weft storage unit weft winding arm, said downstream side device including means for generating suction by which weft yarn from said weft winding arm is caused to be sucked into said weft guide, and means for ejecting an air jet to project said weft yarn from said downstream side device.

10. A weft threading system as claimed in claim 9, wherein said weft guide includes a generally cylindrical nozzle body having a tapered first nozzle opening, and a cylindrical second nozzle opening connected to said first nozzle opening, an axis of said second nozzle opening being aligned with an axis of said weft inserting nozzle; and a generally cylindrical needle having a tapered section which is disposed in said first nozzle opening of said nozzle body to define an annular air ejection opening between a tapered outer surface of said needle tapered section and a tapered inner surface of said nozzle body, said air ejection opening being communicable with a pressurized air source, said needle being formed with a weft introduction opening and communicating with said nozzle body first nozzle opening, weft yarn from said weft winding arm being passed through said weft introduction opening and through said first and second nozzle openings.

11. A weft threading system as claimed in claim 9, wherein said downstream side device includes a weft inserting nozzle disposed downstream of and separate from said weft winding arm, said weft inserting nozzle including means for generating suction by which weft yarn from said weft winding arm is caused to be sucked into said weft inserting nozzle, and means for ejecting an air jet by which weft yarn is picked into a shed of warp yarns.

12. A weft threading system as claimed in claim 11, wherein said weft inserting nozzle includes a generally cylindrical nozzle body, a weft introduction pipe coaxially fitted in said nozzle body and having a weft introduction opening through which weft yarn from said weft winding arm is introduced, said weft introduction pipe having a tapered section, a weft projection pipe formed with a tapered inner surface located around said weft introduction pipe tapered section to define therebetween a first air ejection opening through which an air jet passes to be ejected through said weft projection pipe, and means, incorporated with said weft projection pipe, for defining a second air ejection opening through which an air jet passes to be ejected from said tip end of said weft projection pipe.

* * * * *